US007472899B2

(12) United States Patent
Moriyama et al.

(10) Patent No.: US 7,472,899 B2
(45) Date of Patent: Jan. 6, 2009

(54) SHEET PROCESSING APPARATUS, IMAGE FORMING APPARATUS, CONTROL METHOD, AND PROGRAM

(75) Inventors: Tsuyoshi Moriyama, Toride (JP); Takayuki Fujii, Toshima-ku (JP)

(73) Assignee: Canon Kabushiki Kaisha (JP)

( * ) Notice: Subject to any disclaimer, the term of this patent is extended or adjusted under 35 U.S.C. 154(b) by 269 days.

(21) Appl. No.: 11/466,024

(22) Filed: Aug. 21, 2006

(65) Prior Publication Data

US 2007/0045923 A1 Mar. 1, 2007

(30) Foreign Application Priority Data

Aug. 30, 2005 (JP) ..... 2005-250118

(51) Int. Cl.
*B65H 37/04* (2006.01)

(52) U.S. Cl. ..... 270/58.08

(58) Field of Classification Search ..... 270/58.08
See application file for complete search history.

(56) References Cited

U.S. PATENT DOCUMENTS 6,474,633 B1 * 11/2002 Hirai ..... 270/58.09
2006/0017210 A1 * 1/2006 Sato et al. ..... 270/58.08

FOREIGN PATENT DOCUMENTS

JP 2001-105347 A 4/2001
JP 2001171898 A * 6/2001

* cited by examiner

*Primary Examiner*—Gene Crawford
*Assistant Examiner*—Leslie A Nicholson, III
(74) *Attorney, Agent, or Firm*—Rossi, Kimms & McDowell LLP

(57) ABSTRACT

The present invention is characterized in a sheet processing apparatus comprising a sheet processing device which binds a sheet stack with a binder and cuts off an excess part of the binder; a first containing portion which contains at least one binder excess cut off by the sheet processing device; a second containing portion which can contain the at least one binder excess contained in the first containing portion; and a controller which controls movement of the at least one binder excess contained in the first containing portion to the second containing portion on the basis of the volume of the at least one binder excess in the first containing portion.

6 Claims, 19 Drawing Sheets

| | THE NUMBER OF SHEETS TO BE STAPLED | |
|---|---|---|
| | 2 TO 50 | 51 TO 100 |
| FACTOR | 1 | 0.5 |

SHEET PROCESSING APPARATUS, IMAGE FORMING APPARATUS, CONTROL METHOD, AND PROGRAM

BACKGROUND OF THE INVENTION

1. Field of the Invention

The present invention relates to a sheet processing apparatus comprising a stapler which binds a sheet stack with a staple and cuts off an excess part of the staple, an image forming apparatus, a control method, and a program.

2. Description of the Related Art

There is conventionally available a sheet binding apparatus which is configured to bind a sheet stack at an arbitrary position of an edge of the sheet stack by moving a binding mechanism portion (stapler) along the sheet stack aligned on a loading tray on which sheets are loaded.

Examples of a sheet binding apparatus annexed to an image forming apparatus such as a copier include one which performs the following processing. More specifically, the sheet binding apparatus conveys sheets bearing toner images formed by an image forming portion of the image forming apparatus to a loading tray, aligns a predetermined number of ones of the sheets, moves a stapler to a predetermined position of an edge of the sheet stack aligned on the loading tray, and performs binding.

There is also proposed a stapler described in Japanese Patent No. 03,541,273. When there are a large number of materials to be bound (sheets) on a binding table, a staple with long legs is used. If a small number of materials to be bound are bound with a staple with long legs, the two legs of the staple overlap each other at the time of bending the legs. To prevent this, there is known a stapler comprising a mechanism which cuts off a part, other than a part necessary for binding, of each of the legs of a staple extending through materials to be bound on a binding table and projecting from the back of the materials to be bound and clinches the staple. In a stapler of this type, partial staple legs cut off are accumulated in a containing box provided to the stapler.

However, if the stapler described in Japanese Patent No. 03,541,273 is applied to the above-described sheet binding apparatus, the following problem occurs. More specifically, if consecutive staple jobs (the jobs of binding a sheet stack) are executed, partial staple legs cut off by the stapler are accumulated in the containing box provided to the stapler. Sooner or later, the containing box is filled with partial staple legs, and as a result, some of the partial staple legs overflow the containing box and scatter in a sheet processing apparatus, which is a problem.

SUMMARY OF THE INVENTION

The object of the present invention is to provide a sheet processing apparatus, image forming apparatus, control method, and program which can prevent partial staple legs cut off from overflowing a containing portion and improve the usability.

In order to achieve the above-described object, a sheet processing apparatus of the present invention is characterized in comprising: a sheet processing device which binds a sheet stack with a binder and cuts off an excess part of the binder; a first containing portion which contains at least one binder excess cut off by said sheet processing device; a second containing portion which can contain the at least one binder excess contained in said first containing portion; and a controller which controls movement of the at least one binder excess contained in said first containing portion to said second containing portion on the basis of the volume of the at least one binder excess in said first containing portion.

To achieve the object, a control method of the present invention is characterized in comprising a sheet processing device which binds a sheet stack with a binder and cuts off an excess part of the binder, a first containing portion which contains at least one binder excess cut off by the sheet processing device, and a second containing portion which can contain the at least one binder excess contained in the first containing portion, comprising: a determination step of determining the volume of the at least one binder excess contained in the first containing portion; and a control step of controlling movement of the at least one binder excess in the first containing portion to the second containing portion on the basis of a determination result obtained in the determination step.

To achieve the object, a program of the present invention is characterized in comprising: a determination module which determines the volume of the at least one binder excess contained in the first containing portion; and a control module which controls movement of the at least one binder excess in the first containing portion to the second containing portion on the basis of a determination result from the determination module.

Further features of the present invention will become apparent from the following description of exemplary embodiments with reference to the attached drawings.

DESCRIPTION OF THE EMBODIMENTS

Embodiments of the present invention will be explained below with reference to the drawings.

First Embodiment

Figure 1:
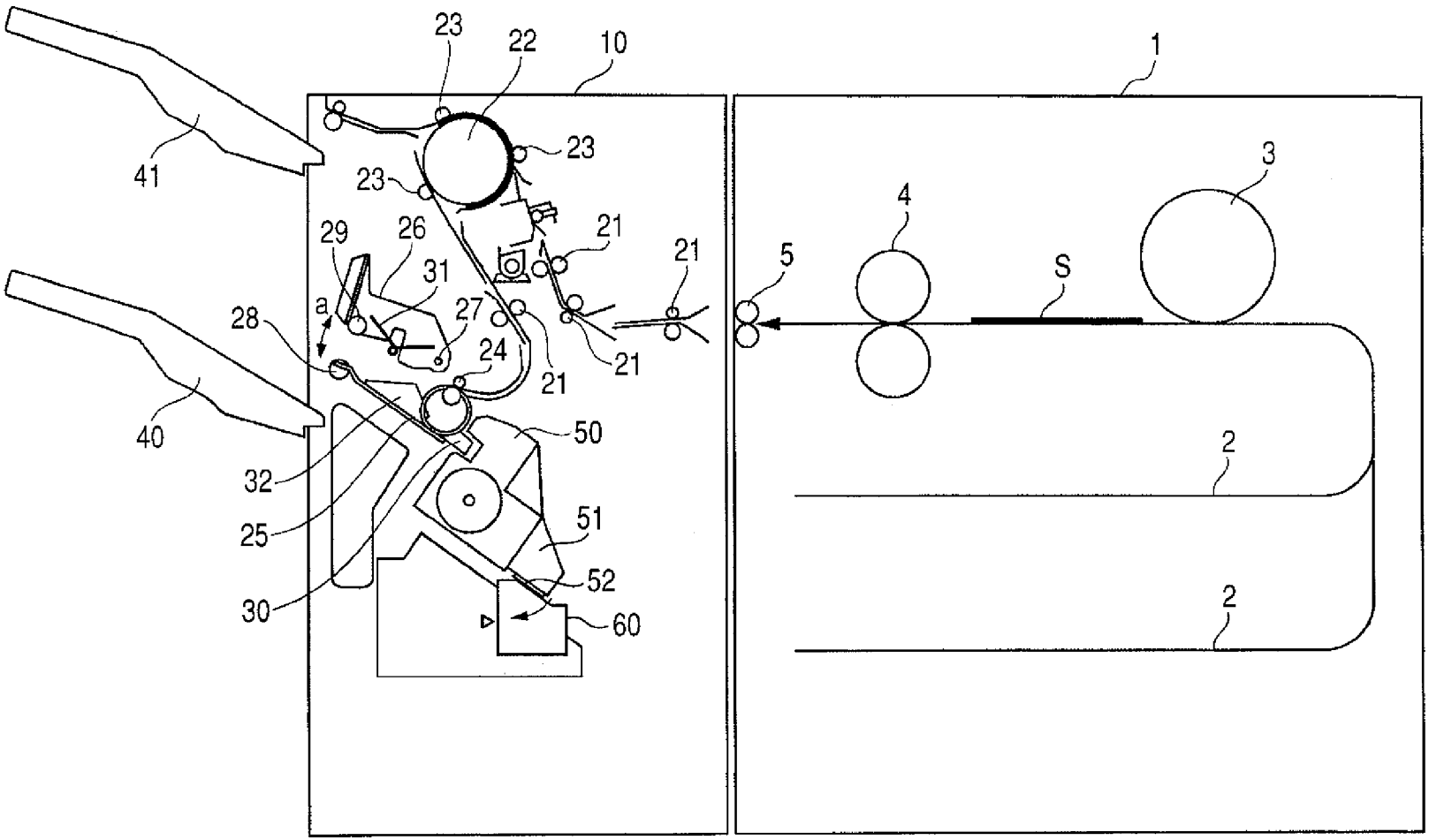
FIG. 1 is a configuration view showing the schematic configuration of an image forming apparatus and a sheet post-processing apparatus as a sheet processing apparatus according to a first embodiment of the present invention.

FIG. 1 is a configuration view showing the schematic configuration of an image forming apparatus and a sheet post-processing apparatus as a sheet processing apparatus according to a first embodiment of the present invention.

In FIG. 1, an image forming apparatus 1 comprises a paper feed portion 2, a photoconductor drum 3, a fixing portion 4, a pair of delivery rollers 5, and the like. A sheet post-processing apparatus 10 comprises pairs of convey rollers 21, a large roller 22, a processing tray 25, a swing guide 26, a trailing edge alignment member 30, an alignment portion 32, a lower loading tray 40, an upper loading tray 41, a stapler 50, a moving containing portion 51, an open/close cover 52, a staple waste box 60, and the like. Note that only the schematic configuration of a part of the image forming apparatus 1 associated with paper feed, transfer, and fixation is shown and that the configuration of the remainder is not shown.

The flow of conveyance of a sheet in the image forming apparatus 1 and sheet post-processing apparatus 10 will first be explained.

In the image forming apparatus 1, an image is transferred onto a sheet S (to be referred to as a sheet hereinafter), having been separated and fed from the paper feed portion 2, through the cylindrical photoconductor drum 3. After the image having been transferred onto the sheet is fixed by the fixing portion 4, the sheet is conveyed to the sheet post-processing apparatus 10 by the pair of delivery rollers 5.

In the sheet post-processing apparatus 10, the sheet having been conveyed from the image forming apparatus 1 is conveyed to the downstream side of a conveyance path by the pairs of convey rollers 21, large roller 22, and driven rollers 23. The sheet is then conveyed by a pair of lower delivery rollers 24 to the processing tray 25 as sheet loading means for temporarily collecting, aligning, and binding sheets.

The swing guide 26 is configured to be capable of joining and parting from a lower sheet stack delivery roller 28 by being swung on a swing fulcrum 27 as a rotational axis in a direction of an arrow a in FIG. 1. The swing guide 26 is generally in an open state (a state in which the swing guide 26 is spaced apart from the lower sheet stack delivery roller 28) when sheets are delivered to the processing tray 25 one by one. For this reason, the swing guide 26 does not drop to interfere with alignment operation while the sheets are delivered to the processing tray 25. When the sheets are delivered from the processing tray 25 to the lower loading tray 40 as a stack tray, the swing guide 26 moves such that it abuts against the lower sheet stack delivery roller 28 and enters a closed state.

An upper sheet stack delivery roller 29 is supported by the swing guide 26 and conveys the sheet stack on the processing tray 25 in cooperation with the lower sheet stack delivery roller 28, thereby delivering the sheet stack to the lower loading tray 40. The processing tray 25 is an inclined tray with an upper end on the downstream side (the left side of FIG. 1) and a lower end on the upstream side (the right side of FIG. 1). A sheet conveyed by the pair of lower delivery rollers 24 slides on the processing tray 25 until the trailing edge of the sheet abuts against the trailing edge alignment member 30 disposed at the lower end of the processing tray 25 due to the self-weight of the sheet and the action of a paddle 31.

The alignment portion 32 is composed of a front alignment member and rear alignment member which can move independently of each other to the front and rear sides, respectively, of the apparatus in a direction orthogonal to the sheet conveying direction (one orthogonal to the sheet surface of FIG. 1). The alignment portion 32 performs alignment for sheets in the direction orthogonal to the sheet conveying direction (alignment for two edges of each sheet).

The configurations of the lower loading tray 40 and upper loading tray 41 will be explained.

Each of the lower loading tray 40 and upper loading tray 41 is used depending on the situation. Each loading tray comprises a drive mechanism which can move in a self-propelled manner in an almost vertical direction in FIG. 1 and a support mechanism. More specifically, the lower loading tray 40 on the lower side is selected when sheets as copy outputs or print outputs are to be loaded. In contrast, the upper loading tray 41 on the upper side is selected when sheets as outputs at the time of printing samples, outputs in the event of an interruption, outputs in the event of an overflow in the lower loading tray 40, outputs at the time of functional sorting (e.g., FAX reception), or outputs of a mixture of a plurality of jobs are to be loaded.

In each of the lower loading tray 40 and upper loading tray 41, sheet surface detection portions (not shown) are disposed at a plurality of positions as mechanisms which detect the position of the top one of loaded sheets. The position of each of the lower loading tray 40 and upper loading tray 41 is controlled on the basis of information of detection results obtained from the sheet surface detection portions.

The configurations of the stapler 50 and moving containing portion 51 will be explained.

The stapler 50 is disposed near the trailing edge alignment member 30 and configured to be capable of moving in a direction orthogonal to the sheet surface of FIG. 1. The stapler 50 is driven by a DC brush motor (not shown) to perform staple driving operation, i.e., the operation of binding, at an edge, a sheet stack aligned along the trailing edge alignment member 30 with a staple which is a binder used at the time of binding, a type of sheet post-processing. The stapler 50 cuts off a part of each of the legs (ends) of the staple, which is an excess part, with a cutting mechanism (see FIG. 6) in conjunction with the staple driving operation.

The moving containing portion 51 as a first containing portion which contains partial staple legs cut off by the cutting mechanism of the stapler 50 is annexed on a side of the stapler 50. Partial staple legs cut off by the cutting mechanism of the stapler 50 are contained as excesses in the moving containing portion 51 through a movement path (not shown). The staple waste box 60 as a second containing portion for containing partial staple legs having dropped from the moving containing portion 51 after the moving containing portion 51 is filled with partial staple legs is disposed below the moving containing portion 51. In this case, the staple leg storage capacity of the staple waste box 60 is set to be larger than that of the moving containing portion 51.

Note that in this embodiment, it is possible to select an arbitrary one of a plurality of binding modes (stapling modes) including a one-position binding mode and two-position binding mode. The one-position binding mode is a mode of binding a sheet stack at one position (staple position) by the stapler 50. The two-position binding mode is a mode of binding a sheet stack at two positions (first staple position and second staple position) by the stapler 50.

The process of moving partial staple legs as excesses produced by sheet post-processing from the moving containing portion 51 to the staple waste box 60 will be explained with reference to FIGS. 2 to 4.

Figure 2:
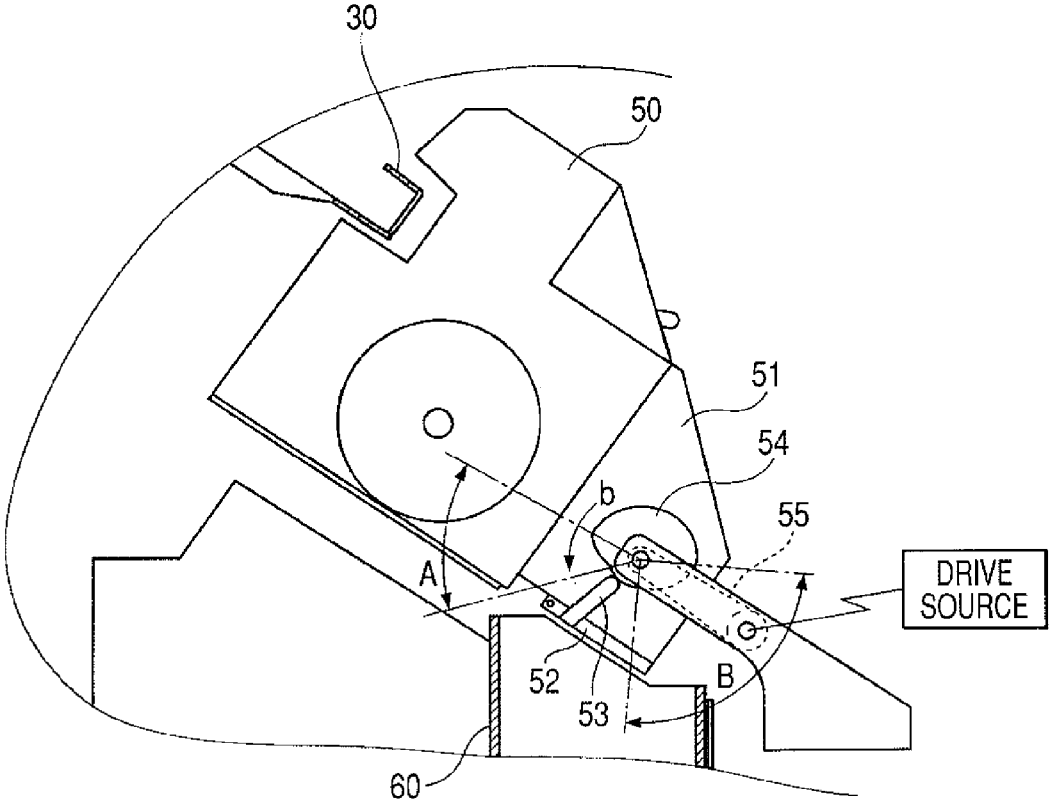
FIG. 2 is a view showing the configuration of a stapler and its vicinity of the sheet post-processing apparatus.

FIG. 2 is a view showing the configuration of the stapler 50 and its vicinity of the sheet post-processing apparatus. FIG. 3 is a view showing a state in which an open lever 53 is pressed down by a releasing cam 54. FIG. 4 is a view showing a state in which the open/close cover 52 of the moving containing portion 51 pivots in a direction shifting the open/close cover 52 from an open state to a closed state.

Figure 3:
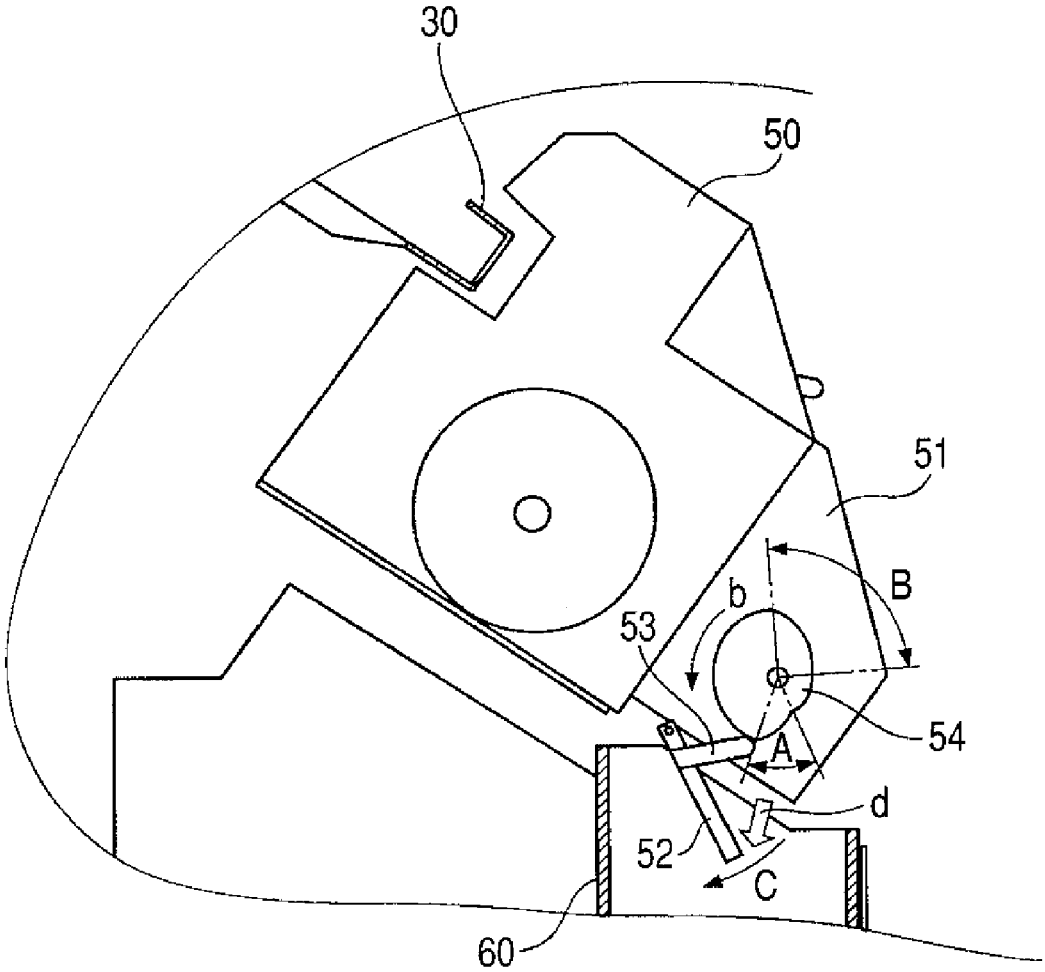
FIG. 3 is a view showing a state in which an open lever is pressed down by a releasing cam.
Figure 4:
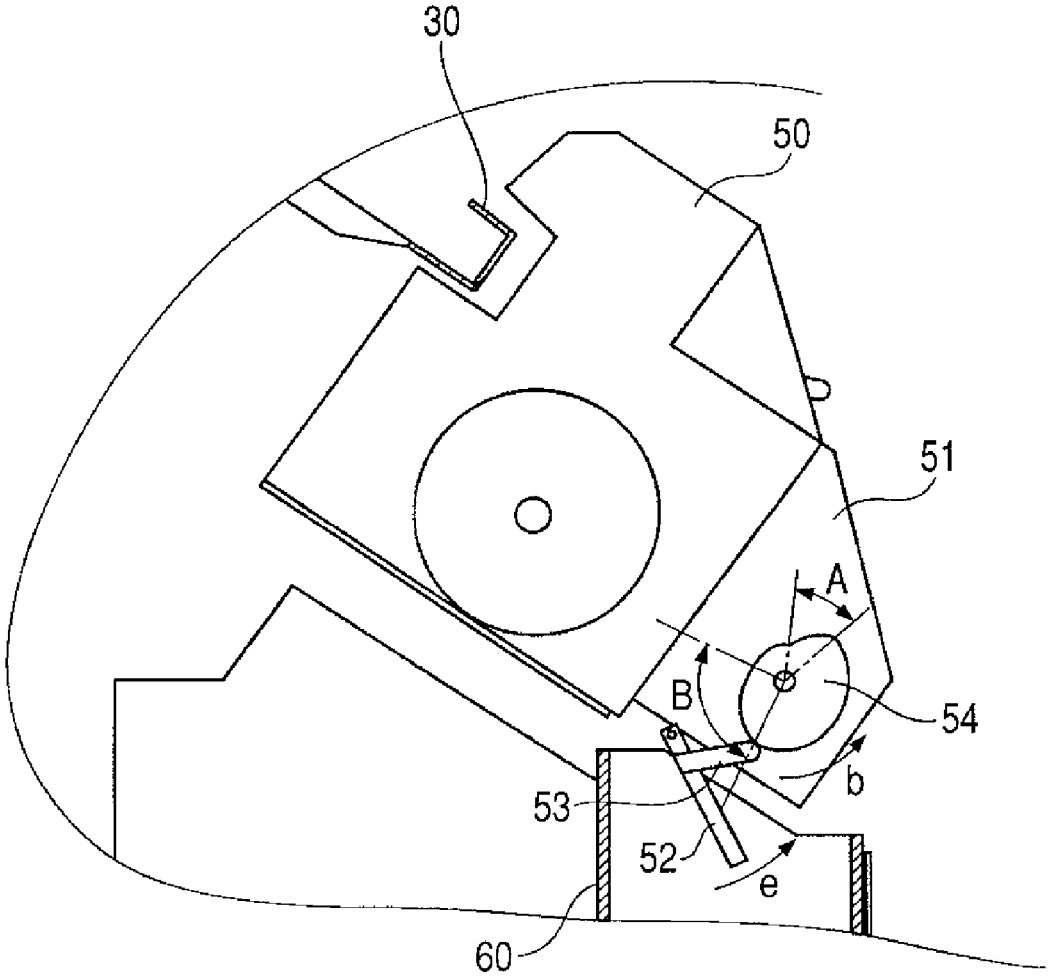
FIG. 4 is a view showing a state in which an open/close cover of a moving containing portion pivots in a direction shifting the open/close cover from an open state to a closed state.

In FIGS. 2 to 4, partial staple legs H (see FIG. 9), having been cut off by the cutting mechanism of the stapler 50 and contained in the moving containing portion 51, are dropped into the staple waste box 60 when the volume of partial staple legs H approaches or reaches the maximum storage capacity of the moving containing portion 51 during binding (staple job). Partial staple legs are contained at the lower portion of the moving containing portion 51 by the action of gravity. The open/close cover 52 as an openable and closable member is disposed at the bottom of the moving containing portion 51. The open/close cover 52 remains in the closed state such that partial staple legs are prevented from dropping during binding or the like.

The open lever 53 is a member for physically controlling the opening and closing operation of the open/close cover 52 and operates to open or close the open/close cover 52 in conjunction with a displacement of the open lever 53. The releasing cam 54 is disposed near the open lever 53 and configured to rotate upon receipt of a driving force from a predetermined drive source through a pulley belt 55. The releasing cam 54 presses down the open lever 53 by rotating in a direction of an arrow b in FIG. 2 (counterclockwise direction) and enters the state shown in FIG. 3.

When the open lever 53 is pressed down by the releasing cam 54, the open/close cover 52 pivots in a direction of an arrow c in FIG. 3 and shifts from the closed state to open state. With this operation, partial staple legs cut off by the cutting mechanism of the stapler 50 drop in a direction of an arrow d in FIG. 3 and are contained in the staple waste box 60. When the releasing cam 54 further rotates and makes one revolution, it enters the state shown in FIG. 4. When the releasing cam 54 makes one revolution, the phase inevitably returns to the original state. The open/close cover 52 pivots in a direction of an arrow e in FIG. 4 and shifts from the open state to closed state.

Note that in FIGS. 2 to 4, an angle A in the releasing cam 54 is the phase angle (rotation angle) of the cam surface when the open/close cover 52 is displaced from the closed state to open state. In contrast, an angle B in the releasing cam 54 is the phase angle (rotation angle) of the cam surface when the open/close cover 52 is displaced from the open state to closed state.

When partial staple legs in the moving containing portion 51 are let to drop into the staple waste box 60 by the action of gravity, opening of the open/close cover 52 in a short time makes it possible to facilitate dropping of partial staple legs cut off and prevents the partial staple legs cut off from remaining in the moving containing portion 51. Closing operation of the open/close cover 52 over a long time reduces problems such as scattering or catching of partial staple legs.

For this reason, this embodiment makes a difference between a time over which the open/close cover 52 is displaced from the closed state to open state and a time over which the open/close cover 52 is displaced from the open state to closed state when the releasing cam 54 is rotated at the same velocity. That is, a cam in which the angles A and B in FIGS. 2 to 4 have a relation of "A<B" is used as the releasing cam 54.

If the rotational angular velocity of the releasing cam 54 is kept constant, a time over which the releasing cam 54 rotates by the angle A, which is a small rotation angle, is made shorter than a time over which the releasing cam 54 rotates by the angle B, which is a large rotation angle. Accordingly, a time required for closing operation of the open/close cover 52 can be made longer than a time required for opening operation. This makes it possible to prevent partial staple legs from scattering or being caught while facilitating dropping of them. A plurality of times of opening and closing operation of the open/close cover 52 also makes it possible to facilitate dropping of partial staple legs. Consecutive repetitions of opening and closing operation of the open/close cover 52 makes it possible to reliably drop partial staple legs.

The positional relationship between the stapler 50 and the staple waste box 60 will be explained with reference to FIGS. 5A and 5B.

Figure 5B:
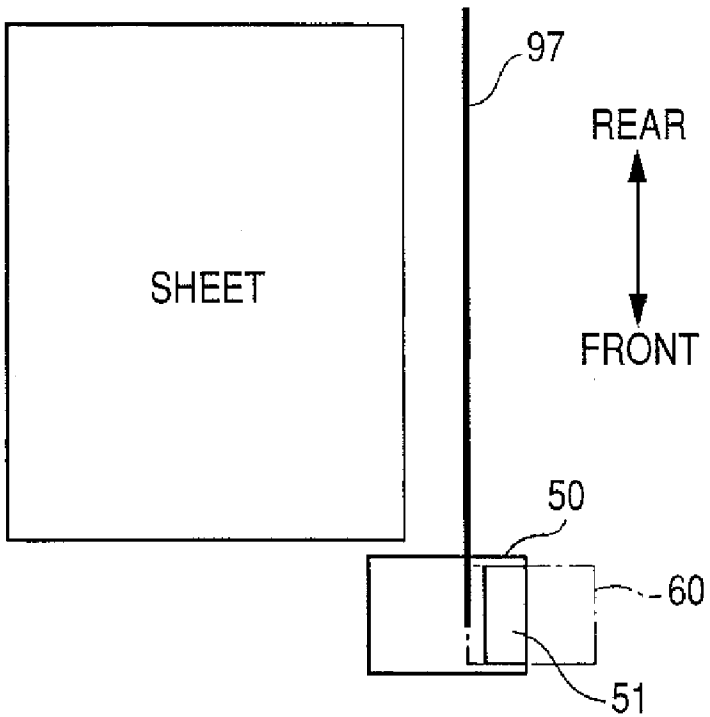
FIG. 5B is a view showing a state in which the stapler has moved to the position of a staple waste box.
Figure 5A:
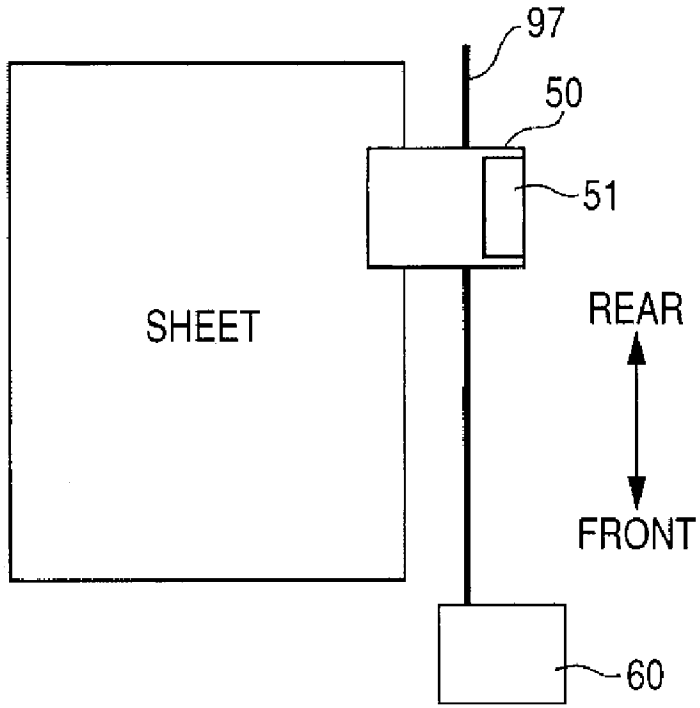
FIG. 5A is a view of the stapler and its vicinity seen from above the apparatus showing a state in which the stapler is stopped at a binding position.

FIG. 5A is a view of the stapler 50 and its vicinity seen from above the apparatus showing a state in which the stapler 50 is stopped at a binding position. FIG. 5B is a view showing a state in which the stapler 50 has moved to the position of the staple waste box 60.

FIG. 5A shows a state in which the stapler 50 is stopped at a binding position (first staple position) on the rear side of the apparatus in the two-position binding mode of binding a sheet stack at two positions. The stapler 50 is configured to be capable of moving between the front side and rear side of the apparatus on a moving rail 97 through a drive belt by a stapler moving motor (not shown) composed of a stepping motor as moving means. Note that the front side of the apparatus is a side corresponding to a maintenance door (not shown) provided on the front of the sheet post-processing apparatus.

FIG. 5B shows a state in which the stapler 50 has moved to the position of the staple waste box 60. When the stapler 50 is to discard partial staple legs contained in the moving containing portion 51, it moves to the upper part of the staple waste box 60 (dotted part) to drop the partial staple legs into the staple waste box 60. Note that in the two-position binding mode, the stapler 50 performs stapling operation of binding a sheet stack at the first staple position and second staple position.

In this embodiment, the staple waste box 60 is disposed near a standby position (stapler home position) during a period (standby time) when a job in which the stapler 50 binds sheets is dormant. The standby position (stapler home position) is set at a position (the position of the stapler 50 in FIG. 5B) on the most front side corresponding to the maintenance door of the sheet post-processing apparatus. That is, the standby position of the stapler 50 is the same as the position where the stapler 50 discards partial staple legs into the staple waste box 60. Accordingly, the stapler 50 is configured such that the open/close cover 52 enters the open state when the stapler 50 moves to the standby position on the most front side of the apparatus.

The schematic configuration of the cutting mechanism of the stapler 50 will be explained with reference to FIGS. 6A and 6B.

Figure 6A:
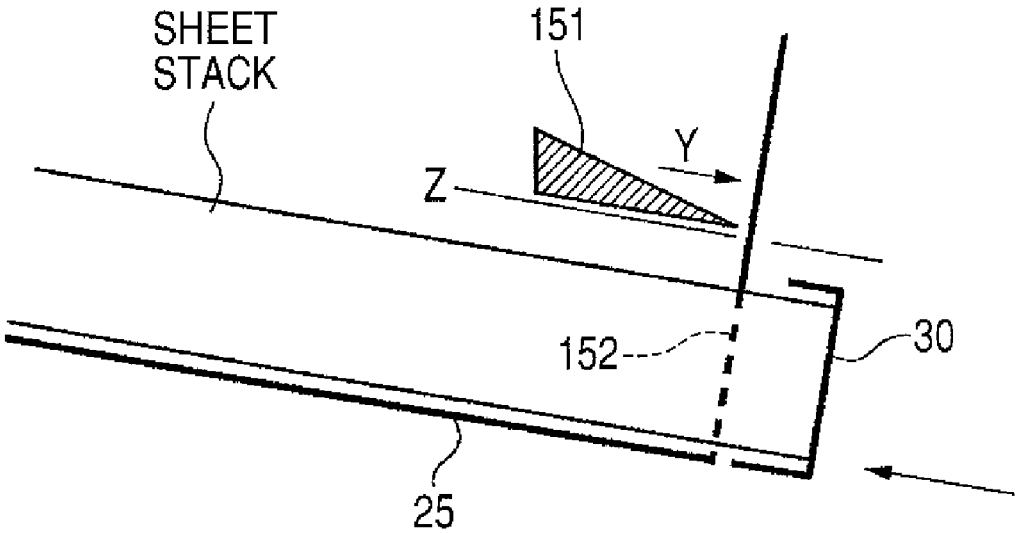
FIG. 6A is a view of a sheet stack loaded on a processing tray seen from the front side of the apparatus showing a state in which the ends of a staple are projecting from the sheet stack.

FIG. 6A is a view of a sheet stack loaded on the processing tray 25 seen from the front side of the apparatus showing a state in which the ends of a staple are projecting from the sheet stack. FIG. 6B is a view showing the state in FIG. 6A seen from a direction of an arrow.

Figure 6B:
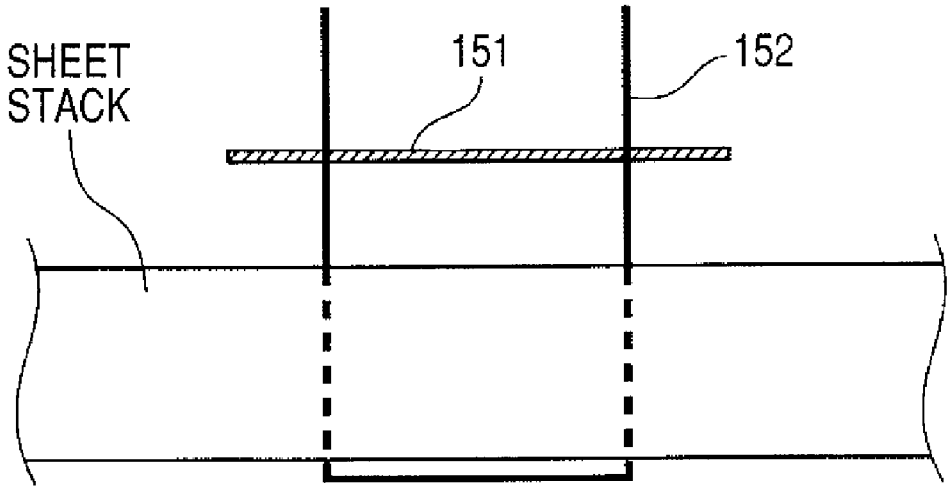
FIG. 6B is a view showing the state in FIG. 6A seen from a direction of an arrow.

In FIGS. 6A and 6B, the stapler 50 comprises a cutter portion 151 as the cutting mechanism. In FIGS. 6A and 6B, reference numeral 152 denotes a staple extending through the sheet stack, and a dotted part of the staple 152 indicates that the part is inside the sheet stack. When a sheet stack consisting of a predetermined number of sheets are loaded on the processing tray 25, the stapler 50 drives the staple 152 into the sheet stack, and the ends of the staple 152 project from the sheet stack, as shown in FIG. 6A.

At this time, since parts above a line (Z) of the staple 152 become excess parts in the step of bending the legs of the staple 152, the cutter portion 151 cuts off the excess parts of the staple legs. The cutter portion 151 cuts off the parts of the staple legs projecting from the line (Z) by moving in a direction of an arrow (Y). In this case, in the two-position binding mode of binding a sheet stack at two positions, the cutter portion 151 almost simultaneously cuts off parts of the legs of the two staples 152.

Partial staple legs cut off are contained in the moving containing portion 51 annexed to the stapler 50. After the cutter portion 151 cuts off parts of the legs of the staples 152, the step of bending the remaining parts of the legs is executed, thereby completing a staple process. The stapler 50 performs operation including staple driving operation, cutting off of parts of staple legs, and the step of bending the remaining parts of the staple legs by being driven by the DC brush motor (not shown).

The mechanism of the staple waste box 60 and detection of the volume of partial staple legs contained in the staple waste box 60 will be explained with reference to FIGS. 7 to 9.

Figure 7:
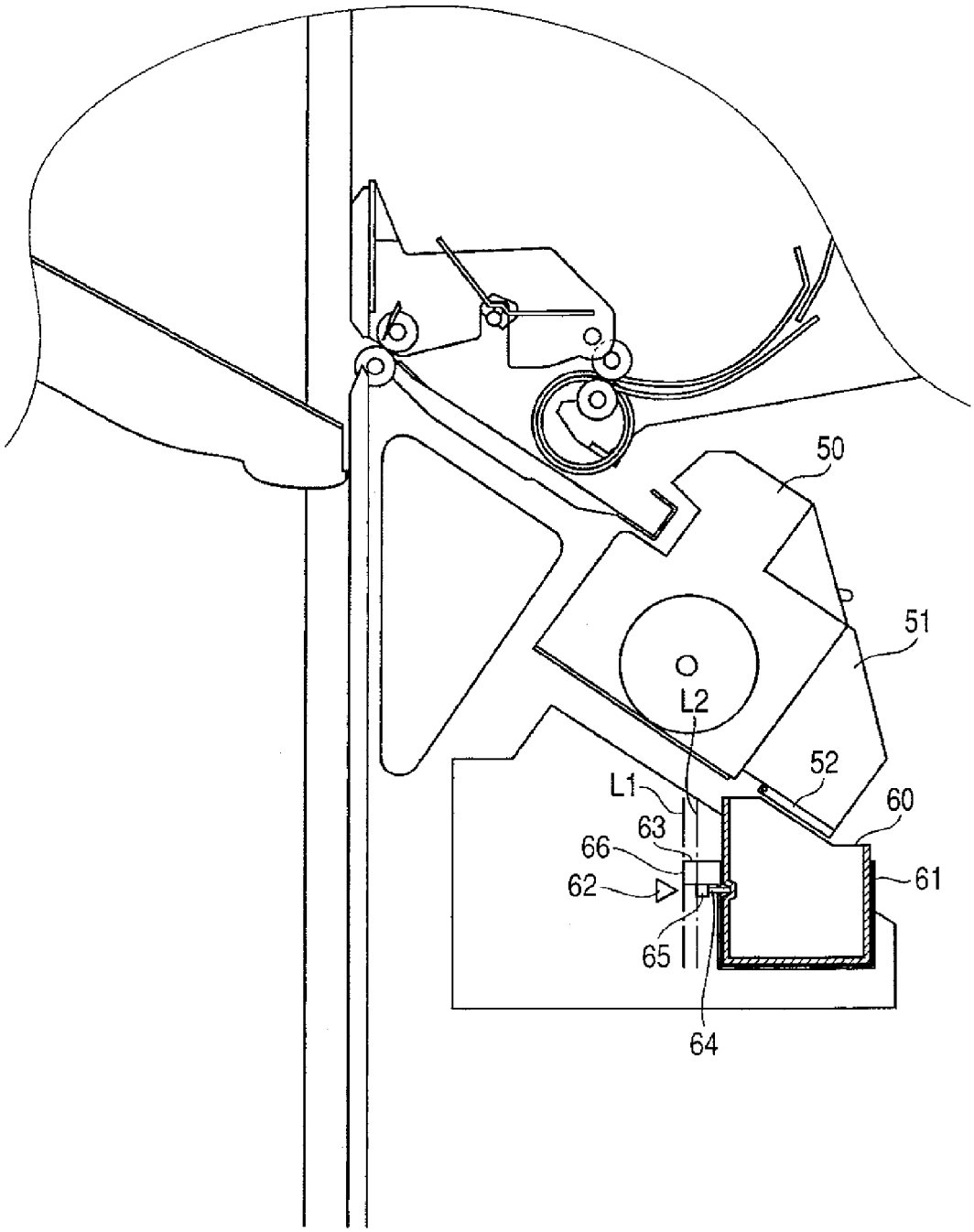
FIG. 7 is a view showing the configuration of the moving containing portion, staple waste box, and their vicinity.

FIG. 7 is a view showing the configuration of the moving containing portion 51, staple waste box 60, and their vicinity. FIG. 8 is a view showing a state in which the staple waste box is not set. FIG. 9 is a view showing a state in which partial staple legs are accumulated in the staple leg box 60.

Figure 8:
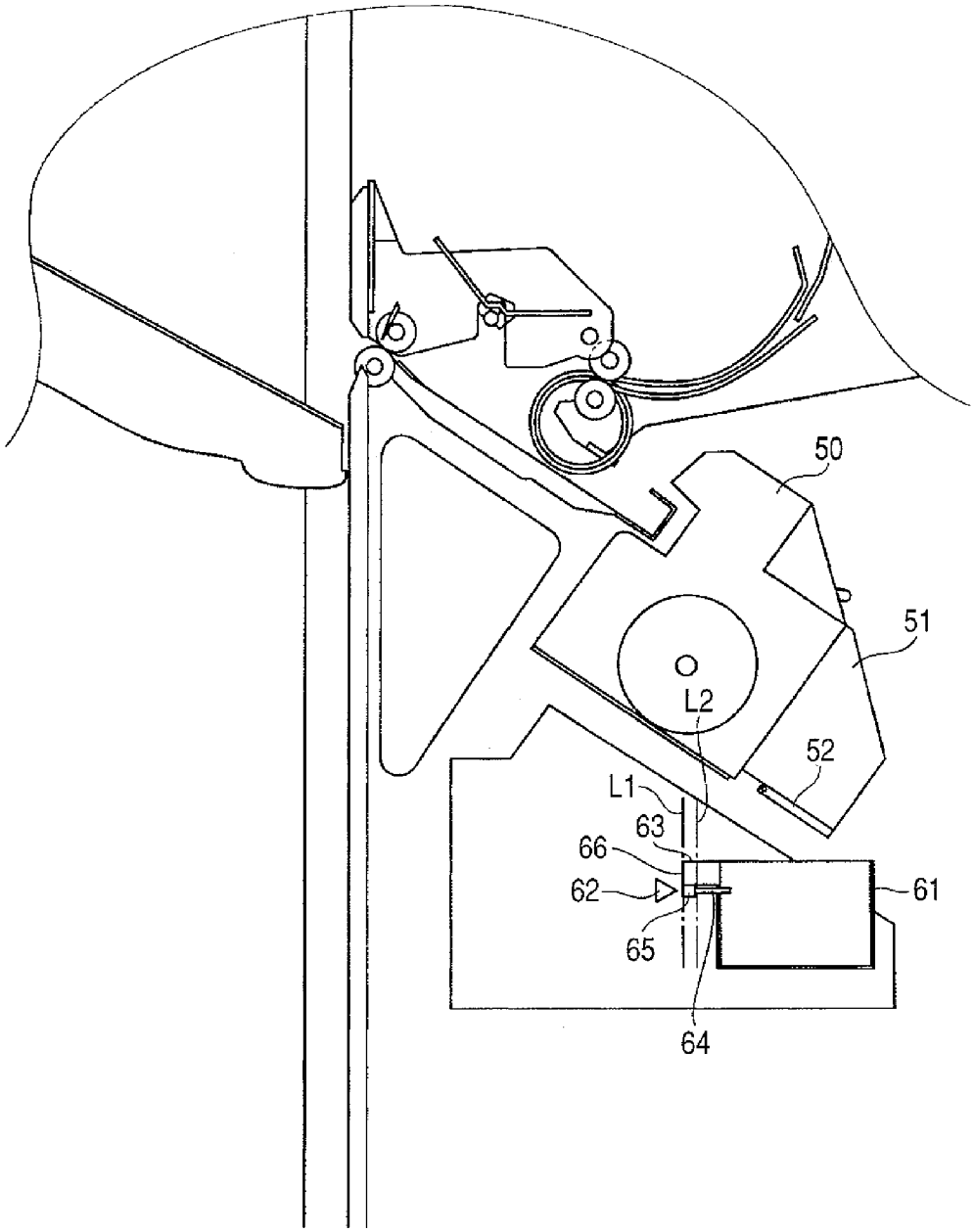
FIG. 8 is a view showing a state in which the staple waste box is not set.
Figure 9:
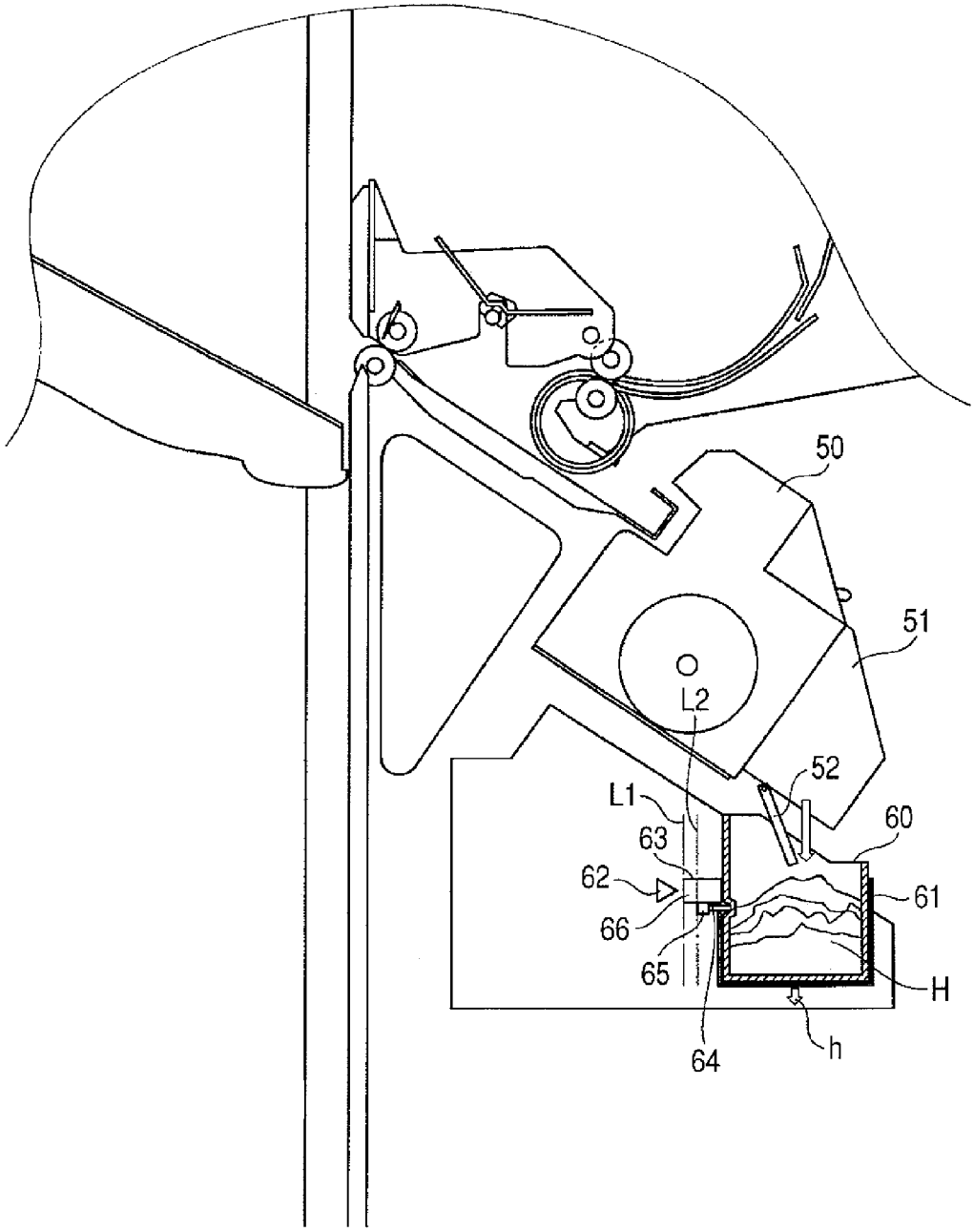
FIG. 9 is a view showing a state in which partial staple legs are accumulated in the staple waste box.

In FIGS. 7 to 9, to efficiently discard partial staple legs contained in the staple waste box 60, it is necessary to detect a state in which the staple waste box 60 is securely set in the sheet post-processing apparatus. It is also necessary to detect the volume of the partial staple legs contained in the staple waste box 60. The staple waste box 60 is supported by a support plate 61. The support plate 61 is capable of moving in the vertical direction in FIGS. 7 to 9 while supporting the staple waste box 60. The support plate 61 is equipped with a detection flag 63 and a staple waste box detection lever 64. Also, a detection portion 62 is disposed on a side of the support plate 61.

When partial staple legs are accumulated in the staple waste box 60, the staple waste box 60 moves in the vertical direction (a direction of an arrow h in FIG. 9) under its self-weight. The detection flag 63 provided to the support plate 61 also moves in conjunction with the movement of the staple waste box 60. The detection flag 63 detects the volume of partial staple legs contained in the staple waste box 60. The staple waste box detection lever 64 is a lever which detects two states, a state (set state) in which the staple waste box 60 is set in the sheet post-processing apparatus and a state (unset state) in which the staple waste box 60 is not set.

A method of detecting the set state/unset state of the staple waste box 60 and a method of detecting the volume of partial staple legs contained in the staple waste box 60 will be explained.

Examples of the detection portion 62 include a reflective sensor. A reflective sensor can detect the state of an object by emitting a signal which differs depending on whether the object is located at a predetermined position with respect to a light-emitting surface. In this embodiment, a signal generated and output from the detection portion 62 differs depending on whether the object is near a line L1 close to the detection portion 62 or the object is near a line L2 which is more remote than the line L1.

A signal output from the detection portion 62 if the object is near the line L1 will be referred to as a "first signal" while one output from the detection portion 62 if the object is near the line L2 will be referred to as a "second signal." Possible cases can be classified into the following three cases (i), (ii), and (iii).

(I) As for the "first signal," there are cases (i) and (ii). The case (i) is a case where the staple waste box 60 is not set in the sheet post-processing apparatus, and a detection surface 65 of the staple waste box detection lever 64 as set state detection means is located near the line L1, as shown in FIG. 8. The case (ii) is a case where partial staple legs are accumulated in the staple waste box 60, the staple waste box 60, support plate 61, and detection flag 63 move down, and a detection surface 66 of the detection flag 63 as staple leg storage volume detection means is located near the line L1, as shown in FIG. 9.

(II) As for the "second signal," there is a case (iii). The case (iii) is a case where the staple waste box 60 is set in the sheet post-processing apparatus, the volume of partial staple legs in the staple waste box 60 has not reached a predetermined volume, and detection surface 65 of the staple waste box detection lever 64 is displaced to be near the line L2, as shown in FIG. 7.

This makes it possible to detect two states using the one detection portion 62. The states are ones associated with the first signal which require a user to check the interior of the sheet post-processing apparatus, a state in which the staple waste box 60 is not set in the sheet post-processing apparatus and a state in which partial staple legs, the volume of which is equal to or more than a predetermined volume, are contained in the staple waste box 60 set in the sheet post-processing apparatus. On the basis of a detection result from the detection portion 62, a necessary message such as a warning can be displayed to a user on e.g., an operation portion of the sheet post-processing apparatus.

Figure 10:
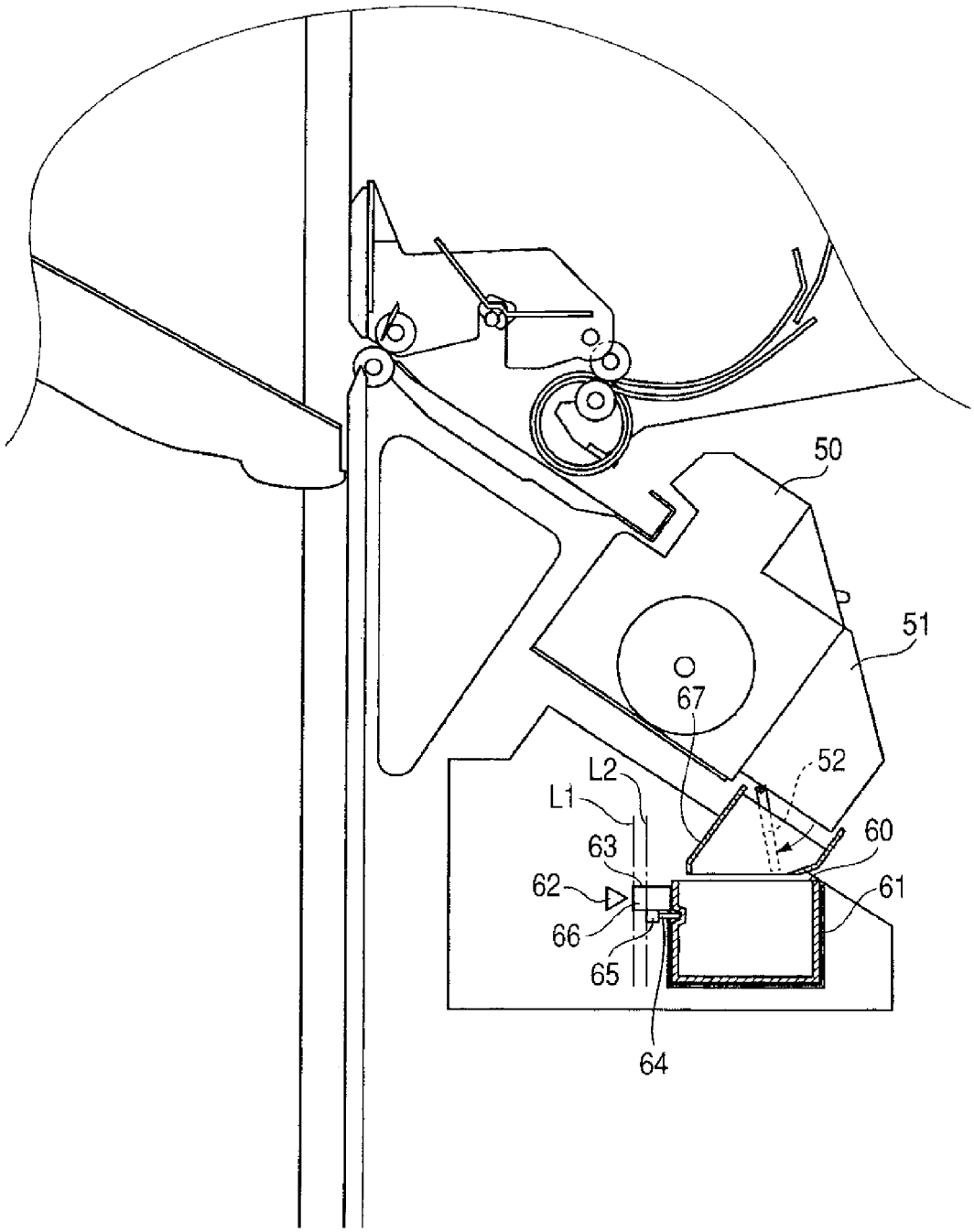
FIG. 10 is a view showing a configuration in which an intermediate fixed guide is disposed between the moving containing portion and the staple waste box.

A configuration which removes the staple waste box 60 outside the sheet post-processing apparatus to discard partial staple legs accumulated in the staple waste box 60 is generally adopted. To improve the operability in removing the staple waste box 60, this embodiment is configured such that the moving range of the open/close cover 52 at the time of opening and closing operation and a direction in which the staple waste box 60 is removed do not interfere with each other. FIG. 10 shows a configuration in which the open/close cover 52 and staple waste box 60 do not impose constraints on each other.

FIG. 10 is a view showing a configuration in which an intermediate fixed guide 67 is disposed between the moving containing portion 51 and the staple waste box 60.

In FIG. 10, the intermediate fixed guide 67 is disposed between the moving containing portion 51 annexed to the stapler 50 and the staple waste box 60. The opening and closing operation of the open/close cover 52 is performed in the intermediate fixed guide 67. This makes it possible to easily remove the staple waste box 60 from the sheet post-processing apparatus regardless of whether the open/close cover 52 is in the open state or closed state.

Of the configuration composed of the image forming apparatus and sheet post-processing apparatus, the configuration of a control system which controls the sheet post-processing apparatus will be explained with reference to FIG. 11.

Figure 11:
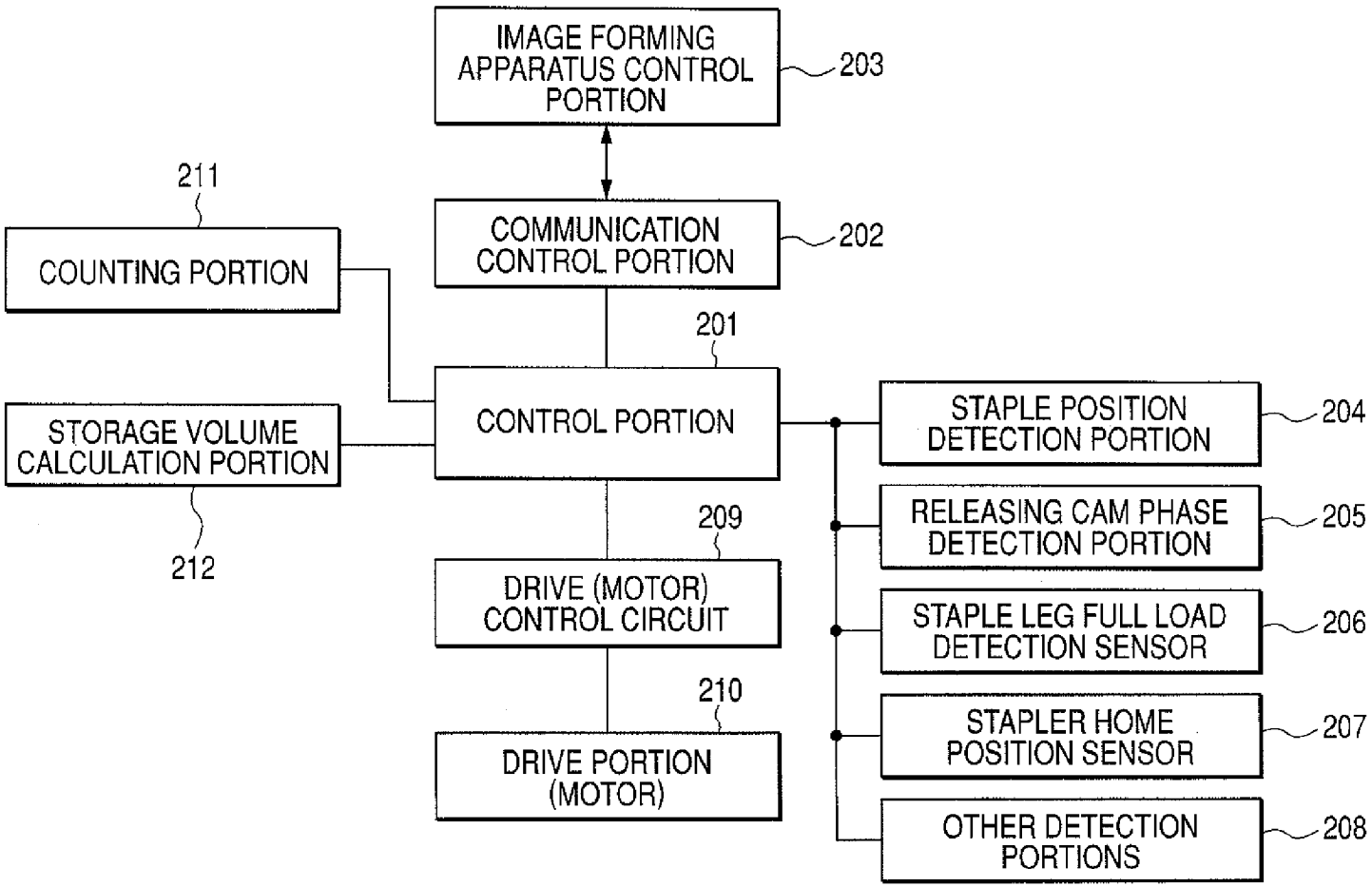
FIG. 11 is a block diagram showing the configuration of a control system centered on the sheet post-processing apparatus.

FIG. 11 is a block diagram showing the configuration of the control system centered on the sheet post-processing apparatus.

In FIG. 11, the sheet post-processing apparatus comprises a control portion 201, a communication control portion 202, a staple position detection portion 204, a releasing cam phase detection portion 205, a staple leg full load detection sensor 101, a stapler home position sensor 207, and other detection portions 208. The sheet post-processing apparatus further comprises a drive control circuit (motor control circuit) 209, a drive portion (motor) 210, a counting portion (staple counter) 211, and a storage volume calculation portion 212. Reference numeral 203 denotes an image forming apparatus control portion disposed on the image forming apparatus side.

The staple position detection portion 204 detects a staple position with respect to a sheet stack. The releasing cam phase detection portion 205 detects the phase angle of the releasing cam 54. The stapler home position sensor 207 detects whether the stapler 50 is located at the stapler home position (standby position). The other detection portions 208 include a sensor which detects passage of a sheet through the conveyance path. The staple leg full load detection sensor 101 detects whether the moving containing portion 51 is filled with partial staple legs and is configured as, e.g., a reflective sensor. The staple leg full load detection sensor 101 will be explained later in a third embodiment.

Detection signals from the staple position detection portion 204, releasing cam phase detection portion 205, staple leg full load detection sensor 101, stapler home position sensor 207, and other detection portions 208 are supplied to the control portion 201. The control portion 201 is composed of a CPU, ROM storing a program and a weighting table (to be described later), RAM used to, e.g., temporarily store data, and the like, all of which are not shown. The control portion 201 executes processes shown in flowcharts (to be described later) in accordance with the program. The communication control portion 202 performs communication processing between the control portion 201 and the image forming apparatus control portion 203.

The counting portion (staple counter) 211 counts the number of times of stapling, i.e., the operation of binding a sheet stack in a staple job. The storage volume calculation portion 212 calculates the staple leg storage volume of the moving containing portion 51 on the basis of a counting result from the counting portion 211, the weighting table, and the like. The control portion 201 supplies a control signal to the drive control circuit 209 on the basis of the detection signals and a staple leg storage volume calculation result. The drive control circuit 209 generates a drive control signal and outputs the signal to the drive portion 210 to drive the drive portion 210, thereby driving loads such as the stapler 50, which perform stapling operation composed of staple driving operation and staple cutting operation, and the releasing cam 54.

A staple process of the sheet post-processing apparatus will be explained with reference to the flowchart in FIG. 12.

Figure 12:
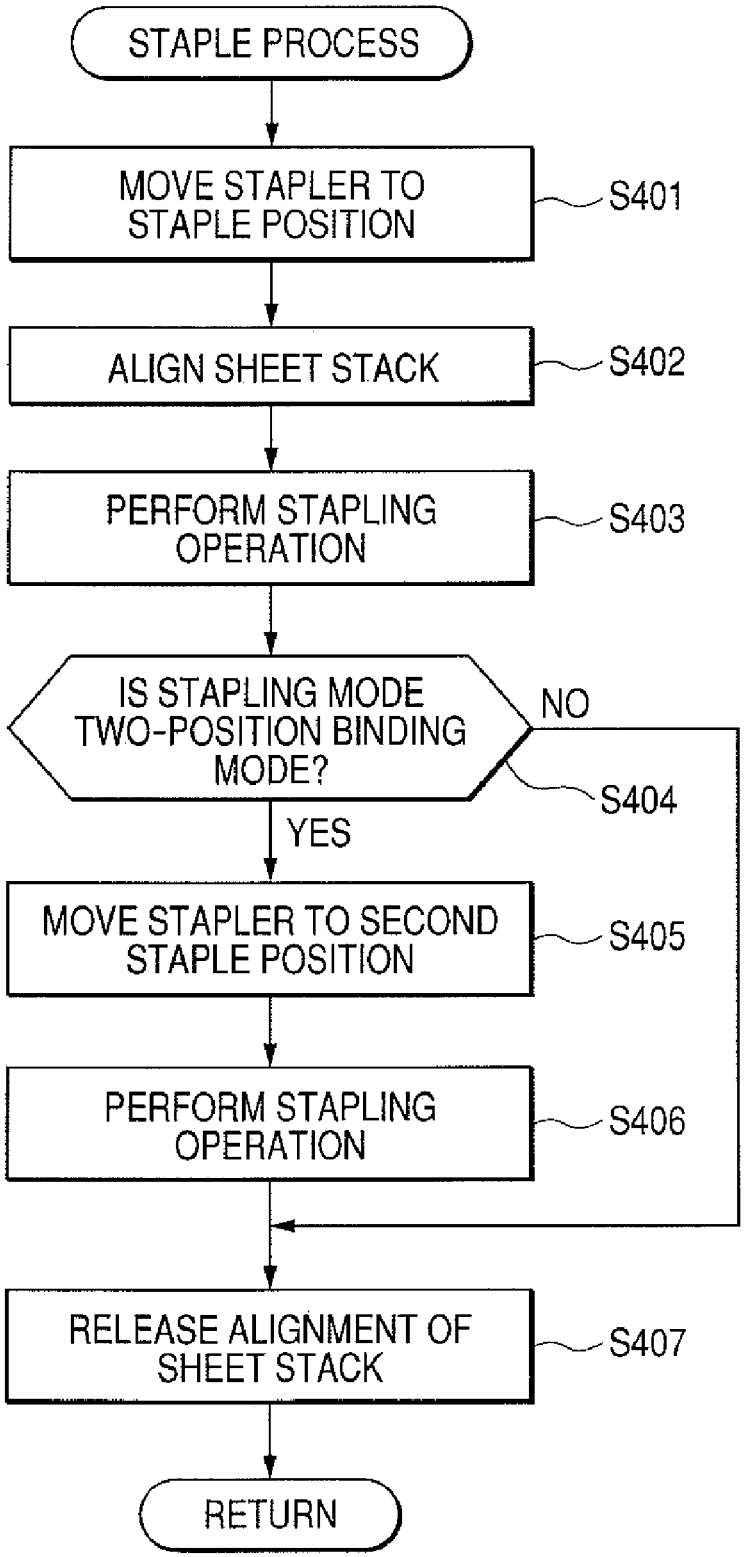
FIG. 12 is a flowchart showing a staple process.

FIG. 12 is a flowchart showing the staple process.

In FIG. 12, the control portion 201 of the sheet post-processing apparatus enters a stapling mode and moves the stapler 50 to a staple position by a predetermined volume (step S401). The control portion 201 aligns a sheet stack on the processing tray 25 with the alignment portion 32 composed of the front alignment member and rear alignment member (step S402) and performs stapling operation at the staple position with the stapler 50 (step S403). The control portion 201 determines whether the stapling mode is the two-position binding mode of binding a sheet stack at two positions (step S404).

If the control portion 201 determines that the stapling mode is not the two-position binding mode, it releases alignment of the sheet stack by the alignment portion 32 (step S407) and ends the process. On the other hand, if the control portion 201 determines that the stapling mode is the two-position binding mode, it moves the stapler 50 from the staple position (first staple position) to the second staple position by the predetermined volume (step S405) and performs stapling operation at the second position (step S406). The control portion 201 releases alignment of the sheet stack by the alignment portion 32 (step S407) and ends the process. When stapling for the last sheet stack ends, the stapler 50 moves to the standby position.

The characteristic parts of this embodiment will be explained next.

In this embodiment, the maximum staple leg storage capacity of the moving containing portion 51 is set to, e.g., a volume corresponding to "200 partial staple legs." Accordingly, partial staple legs corresponding to 100 sheet stacks can be contained in the moving containing portion 51 in the two-position binding mode, and ones corresponding to 200 sheet stacks can be contained in the one-position binding mode. However, when the staple process is performed for in the sheet post-processing apparatus, and the volume of partial staple legs corresponding to the sheet stacks exceeds the maximum staple leg storage capacity of the moving containing portion 51, partial staple legs may overflow the moving containing portion 51 during jobs.

The process of preventing partial staple legs from overflowing the moving containing portion 51 and the process of discarding partial staple legs will be explained with reference to FIGS. 13 and 14.

Figure 13:
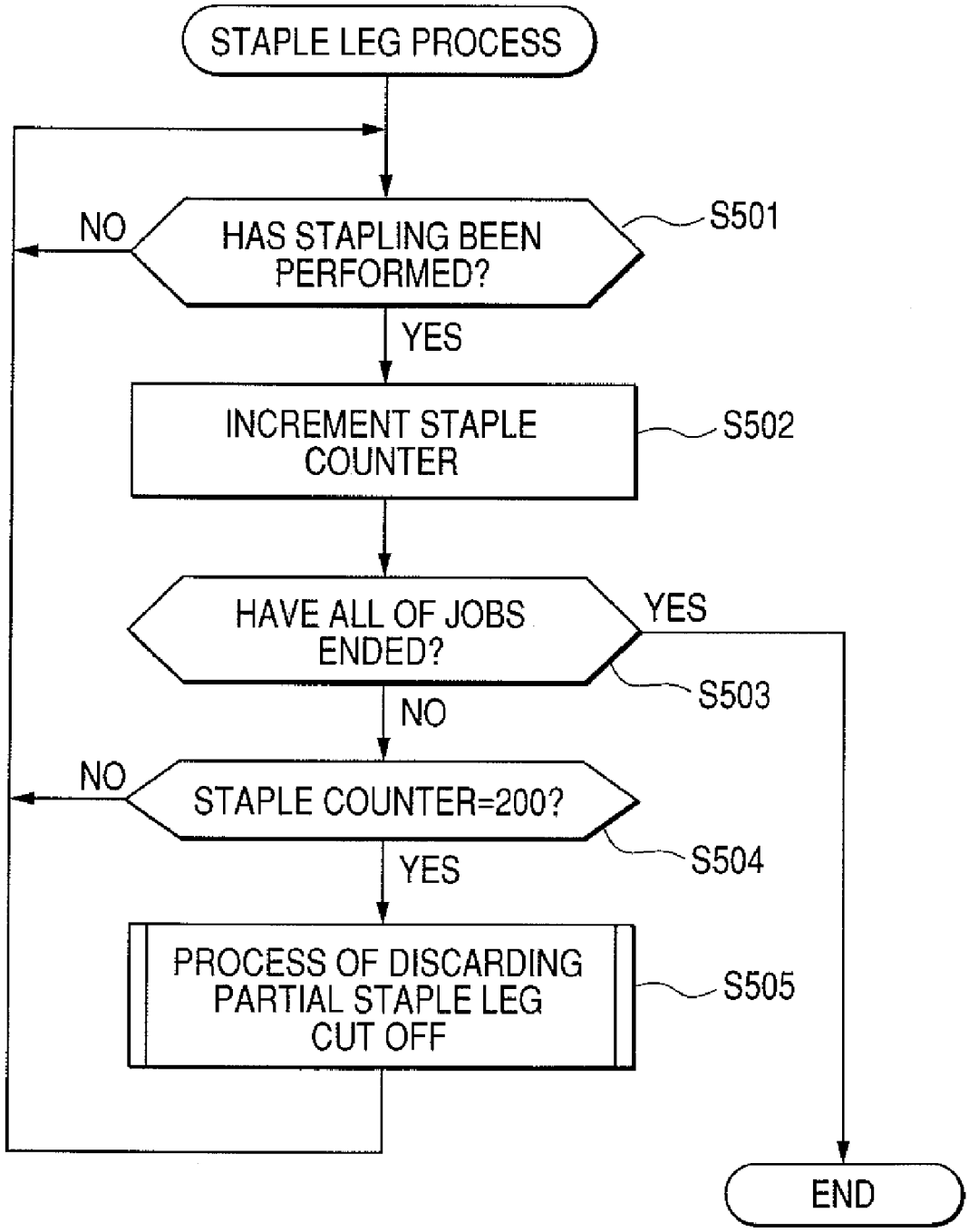
FIG. 13 is a flowchart showing a staple leg process.

FIG. 13 is a flowchart showing a staple leg process.

In FIG. 13, assume, as a job, a staple job of binding a sheet stack. The control portion 201 of the sheet post-processing apparatus determines whether the stapler 50 has stapled a sheet stack loaded on the processing tray 25 (step S501). If the control portion 201 determines that the stapler 50 has stapled the sheet stack, it increments a staple counter which counts the number of times of stapling (the number of times of binding) by the stapler 50 (step S502). The control portion 201 determines whether all of jobs have ended (step S503). If the control portion 201 determines that all of the jobs have ended, it ends the process.

On the other hand, if the control portion 201 determines that there is a succeeding staple job, it determines whether the count of the staple counter has reached 200 (step S504). If the control portion 201 determines that the count of the staple counter is less than 200, the flow returns to step S501. If the control portion 201 determines that the count of the staple counter has reached 200, it performs the process (FIG. 14) of discarding partial staple legs cut off contained in the moving containing portion 51 (step S505). When the process of discarding the partial staple legs ends, the flow returns to step S501.

Figures 14, 15:
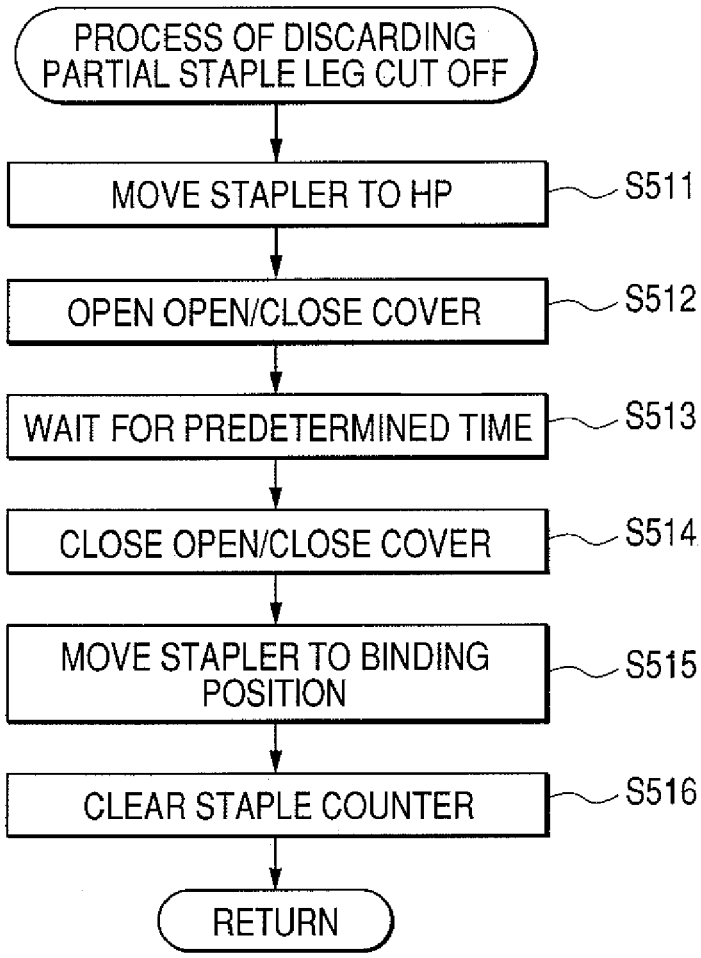
FIG. 14 is a flowchart showing the process of discarding partial staple legs cut off.
FIG. 15 is a chart showing an example of a weighting factor set depending on the number of sheets of a sheet stack to be stapled in a sheet post-processing apparatus as a sheet processing apparatus according to a second embodiment of the present invention.

FIG. 14 is a flowchart showing the process of discarding partial staple legs cut off.

In FIG. 14, the control portion 201 of the sheet post-processing apparatus moves to the stapler home position (standby position) (step S511). The stapler home position is set at a position on the most front side corresponding to the maintenance door of the sheet post-processing apparatus, as described above. When the stapler 50 reaches the stapler home position, the control portion 201 opens the open/close cover 52 by rotating the releasing cam 54 (step S512).

The control portion 201 waits for a predetermined time (e.g., 2 seconds) until partial staple legs drop from the moving containing portion 51 into the staple waste box 60 (step S513). The control portion 201 closes the open/close cover 52 by rotating the releasing cam 54 (step S514). The control portion 201 moves the stapler 50 to the staple position (binding position) (step S515) to prepare for a succeeding staple job. The control portion 201 clears the staple counter to 0 (step S516) and ends the process.

As described above, partial staple legs can be prevented from overflowing the moving containing portion 51 by performing the staple leg process before the volume of partial staple legs exceeds the staple leg storage capacity of the moving containing portion 51. When each job ends, the control portion 201 returns the stapler 50 to the stapler home position and discards partial staple legs accumulated in the moving containing portion 51 into the staple waste box 60 to prepare for the next job. With this process, the moving containing portion 51 can be emptied before the start of the next job. At this time, the staple counter is cleared to 0.

As has been explained above, according to this embodiment, since partial staple legs in the moving containing portion 51 are discarded into the staple waste box 60 on the basis of a result of calculating the volume of partial staple legs in the moving containing portion 51, the process of discarding partial staple legs in the moving containing portion 51 at an appropriate time can be performed. This makes it possible to prevent partial staple legs from overflowing the moving containing portion 51 and scattering in the sheet post-processing apparatus and improve the usability.

Second Embodiment

A second embodiment of the present invention is different from the first embodiment in the points below. Other components of this embodiment are the same as the corresponding ones of the first embodiment (FIGS. 1 to 11), and an explanation thereof will be omitted.

The length of a part of a staple leg cut off by a cutting mechanism of a stapler 50 of a sheet post-processing apparatus differs depending on the thickness of a sheet stack to be stapled. That is, the larger the thickness of a sheet stack to be stapled, the smaller the length of a part to be cut off of a staple leg. In contrast, the smaller the thickness of a sheet stack to be stapled, the larger the length of a part to be cut off of a staple leg.

For this reason, a weighting factor is set depending on the thickness (the number of sheets) of a sheet stack to be stapled. This embodiment performs control such that the number of partial staple legs which can be contained in a moving containing portion 51 is maximized and that the number of times partial staple legs contained in the moving containing portion 51 are discarded into a staple waste box 60 is reduced.

FIG. 15 is a chart showing an example of a weighting factor set depending on the number of sheets of a sheet stack to be stapled in the sheet post-processing apparatus as a sheet processing apparatus according to this embodiment.

In FIG. 15, the weighting factor is set to 1 if the number of sheets of a sheet stack to be stapled is, e.g., between 2 and 50 inclusive while the weighting factor is set to 0.5 if the number of sheets of the sheet stack to be stapled is, e.g., between 51 and 100 inclusive. Since the length of a part to be cut off of a staple leg for a sheet stack, the number of sheets of which is between 51 and 100 inclusive, is smaller than that for a sheet stack, the number of sheets of which is smaller (thinner), and thus, the length for the former is considered to be 0.5 times that for the latter. A weighting table indicating the weighting factor set with respect to the number of sheets of a sheet stack to be stapled (the number of sheets to be stapled) is stored in ROM of a control portion 201 of the sheet post-processing apparatus.

A staple leg process of this embodiment will be explained with reference to the flowchart in FIG. 16.

Figure 16:
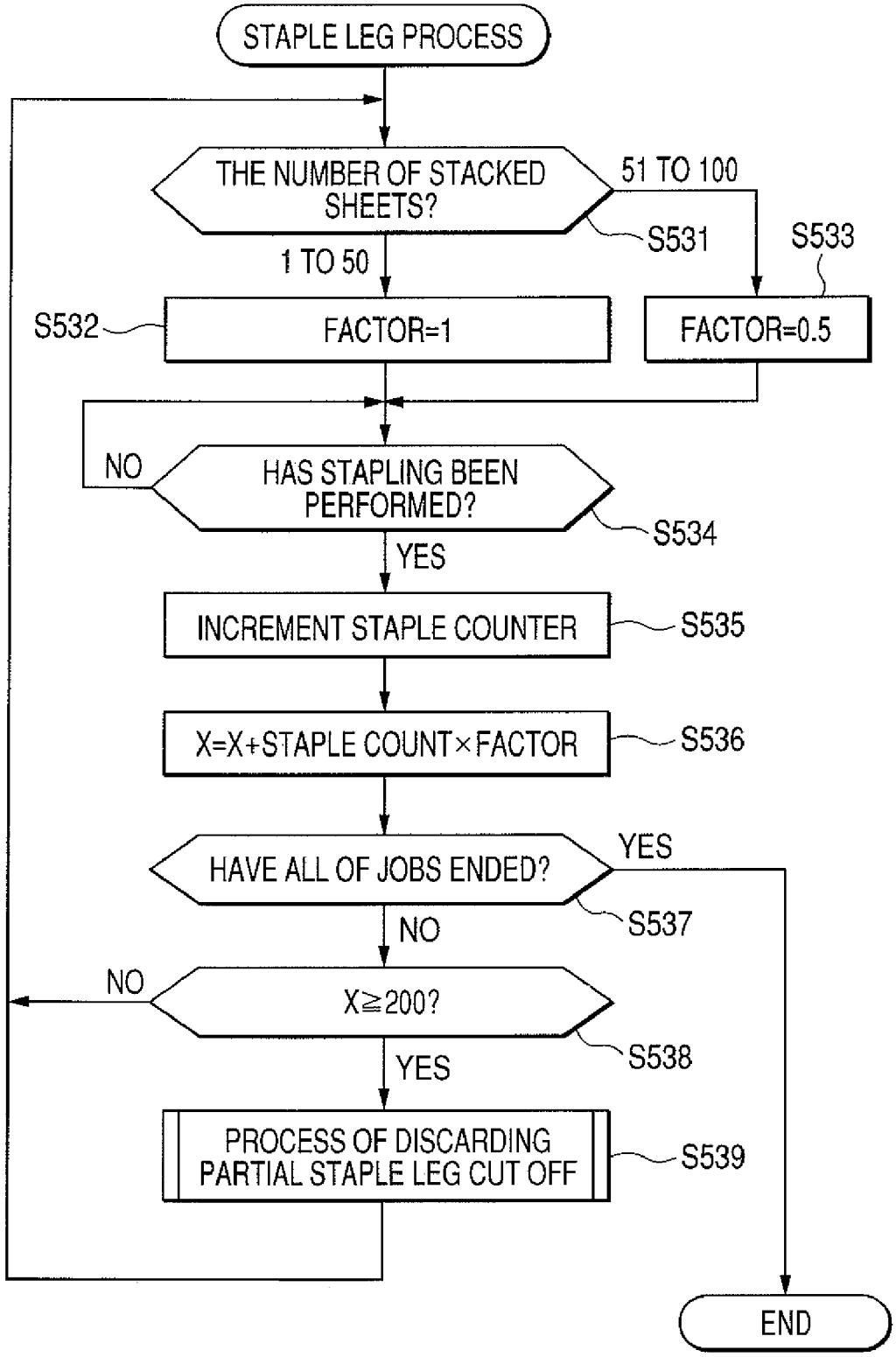
FIG. 16 is a flowchart showing a staple leg process.

FIG. 16 is a flowchart showing the staple leg process.

In FIG. 16, the control portion 201 of the sheet post-processing apparatus determines within which range (2 to 50 or 51 to 100) the number of sheets of a sheet stack to be stapled by the stapler 50 falls (step S531). If the control portion 201 determines that the number of sheets of the sheet stack falls within the range of 2 to 50, it sets the weighting factor to 1 (step S532). On the other hand, if the control portion 201 determines that the number of sheets of the sheet stack falls within the range of 51 to 100, it sets the weighting factor to 0.5 (step S533).

The control portion 201 determines whether the stapler 50 has stapled the sheet stack (step S534). If the control portion 201 determines that the stapler 50 has stapled the sheet stack, it increments a staple counter (step S535). The control portion 201 calculates a value X of a storage volume counter which counts the number of partial staple legs contained in the moving containing portion 51 using the expression "X=X+(count of staple counter)×(weighting factor)" on the basis of the set weighting factor (step S536). In this case, the maximum staple leg storage capacity of the moving containing portion 51 is set to a volume corresponding to 200 partial staple legs.

The control portion 201 determines whether all of jobs have ended (the sheet stack having been stapled is the last sheet stack) (step S537). If the control portion 201 determines that all of the jobs have ended, it ends the process. On the other hand, if the control portion 201 determines that not all of the jobs have ended, it determines whether or not the value X of the storage volume counter has become equal to or more than 200 (step S538).

If the control portion 201 determines that the value X of the storage volume counter is less than 200, the flow returns to step S531. On the other hand, if the control portion 201 determines that the value X of the storage volume counter has become equal to or more than 200, it performs the process of discarding the partial staple legs contained in the moving containing portion 51 into the staple waste box 60 (step S539). The process of discarding partial staple legs cut off is the same as the process (steps S511 to S516) shown in FIG. 14, and an explanation thereof will be omitted. When the process in step S539 ends, the flow returns to step S531.

As has been explained above, according to this embodiment, a weighting factor is changed depending on the number of sheets of a sheet stack to be stapled. Accordingly, if the length of a part of a staple leg cut off by the cutting mechanism of the stapler 50 is small, a larger volume of partial staple legs can be contained in the moving containing portion 51. This makes it possible to increase the number of times of stapling for sheet stacks until partial staple legs are discarded from the moving containing portion 51 into the staple waste box 60. As a result, the number of times partial staple legs are discarded into the staple waste box 60 during jobs can be reduced.

Third Embodiment

A third embodiment of the present invention is different from the first embodiment in the points below. Other components of this embodiment are the same as the corresponding ones of the first embodiment (FIGS. 1 to 11), and an explanation thereof will be omitted.

Figure 17:
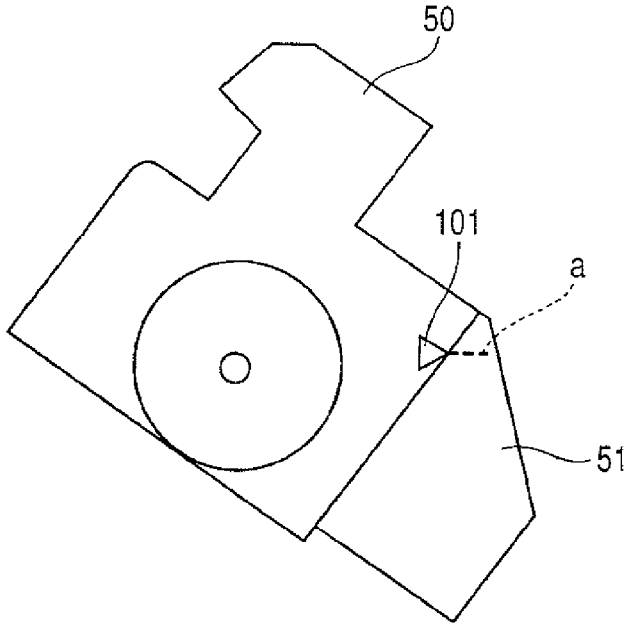
FIG. 17 is a view showing an example in which a staple leg full load detection sensor detects partial staple legs in a sheet post-processing apparatus as a sheet processing apparatus according to a third embodiment of the present invention.

This embodiment adopts, as a method of detecting the volume of partial staple legs contained in a moving containing portion 51, a method of detecting the volume by a staple leg full load detection sensor 101, as shown in FIG. 17.

FIG. 17 is a view showing an example in which the staple leg full load detection sensor 101 detects partial staple legs in a sheet post-processing apparatus as a sheet processing apparatus according to this embodiment.

In FIG. 17, the staple leg full load detection sensor 101 is disposed near the moving containing portion 51, at a position facing an opening at the upper end of the moving containing portion 51. The staple leg full load detection sensor 101 detects whether the top of a pile of partial staple legs cut off by a cutting mechanism of a stapler 50 and contained in the moving containing portion 51 has reached a top part (a part indicated by a dotted line (a)). Note that although a reflective sensor as described above is used as the staple leg full load detection sensor 101, another type of sensor may be used instead.

A staple leg process of this embodiment will be explained with reference to the flowchart in FIG. 18.

Figure 18:
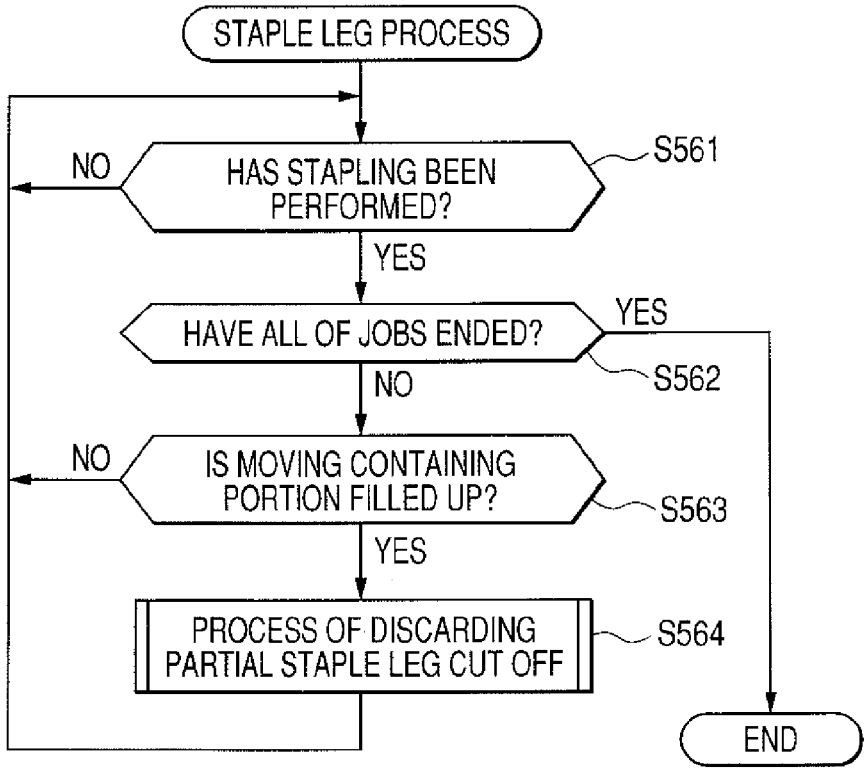
FIG. 18 is a flowchart showing a staple leg process.

FIG. 18 is a flowchart showing the staple leg process.

In FIG. 18, a control portion 201 of the sheet post-processing apparatus first determines whether the stapler 50 has stapled a sheet stack loaded on a processing tray 25 (step S561). If the control portion 201 determines that the stapler 50 has stapled the sheet stack, it determines that all of jobs have ended (step S562). If the control portion 201 determines that all of the jobs have ended, it ends the process. On the other hand, if the control portion 201 determines that there is a succeeding sheet stack to be stapled, it determines whether the moving containing portion 51 is filled with partial staple legs (step S563). The determination is made on the basis of whether the staple leg full load detection sensor 101 detects that the top of a pile of partial staple legs in the moving containing portion 51 has reached the top part (the part indicated by the dotted line (a) in FIG. 17).

If the control portion 201 determines that the moving containing portion 51 is not filled up, the flow returns to step S561. On the other hand, if the control portion 201 determines that the moving containing portion 51 is filled up, it performs the process of discarding the partial staple legs contained in the moving containing portion 51 into a staple waste box 60 (step S564). The process of discarding partial staple legs cut off in step S564 is the same as the process (in steps S511 to S516) shown in FIG. 14, and an explanation thereof will be omitted. When the control portion 201 ends the process of discarding the partial staple legs, the flow returns to step S561.

As has been explained above, according to this embodiment, if the staple leg full load detection sensor 101 detects the top of a pile of partial staple legs in the moving containing portion 51, the process of discarding the partial staple legs in the moving containing portion 51 into the staple waste box 60 is performed. This makes it possible to prevent partial staple legs from overflowing the moving containing portion 51 and scattering in the sheet post-processing apparatus and improve the usability.

Fourth Embodiment

A fourth embodiment of the present invention is different from the first embodiment in the points below. Other components of this embodiment are the same as the corresponding ones of the first embodiment (FIGS. 1 to 11), and an explanation thereof will be omitted.

This embodiment is a modification of the third embodiment. This embodiment determines whether a moving containing portion 51 is filled with partial staple legs, on the basis of a count of a staple counter which counts the number of times of stapling (the number of times of binding) by a stapler 50, and performs the process of discarding partial staple legs in the moving containing portion 51 into a staple waste box 60.

A staple leg process of this embodiment will be explained with reference to the flowchart in FIG. 19.

Figure 19:
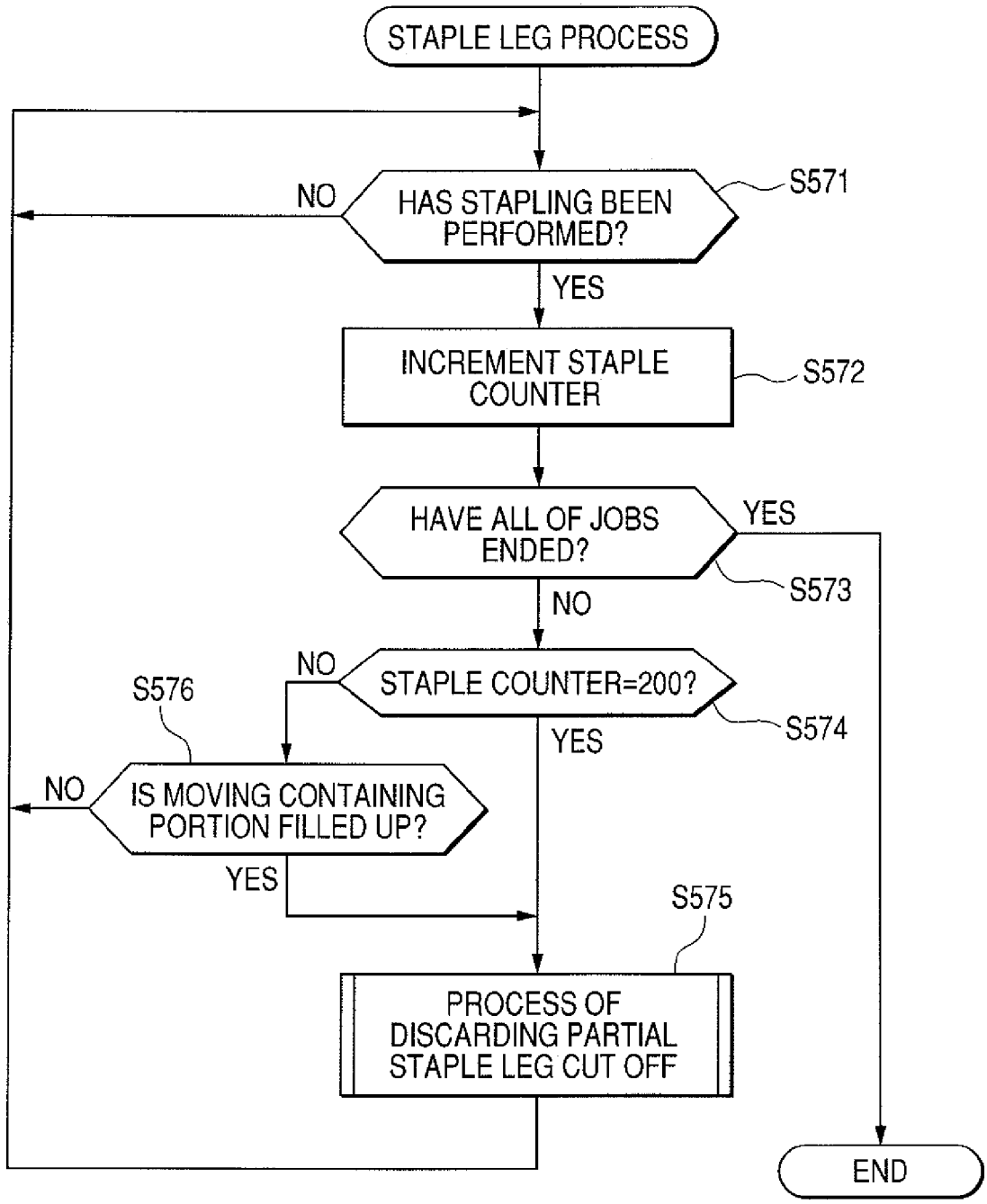
FIG. 19 is flowchart showing a staple leg process in a sheet post-processing apparatus as a sheet processing apparatus according to a fourth embodiment of the present invention.

FIG. 19 is a flowchart showing the staple leg process.

In FIG. 19, a control portion 201 of a sheet post-processing apparatus determines whether the stapler 50 has stapled a sheet stack loaded on a processing tray 25 (step S571). If the control portion 201 determines that the stapler 50 has stapled the sheet stack, it increments the staple counter (step S572). The control portion 201 determines whether all of jobs have ended (step S573).if the control portion 201 determines that all of the jobs have ended, it ends the process.

On the other hand, if the control portion 201 determines that there is a succeeding staple job, it determines whether the count of the staple counter has reached 200 (step S574). If the control portion 201 determines that the count of the staple counter is less than 200, the flow advances to step S576. On the other hand, if the control portion 201 determines that the count of the staple counter has reached 200, the flow advances to step S575.

If the count of the staple counter is less than 200, the control portion 201 determines whether the moving containing portion 51 is filled with partial staple legs (step S576). The determination is made on the basis of whether a staple leg full load detection sensor 101 detects that the top of a pile of partial staple legs in the moving containing portion 51 has reached a top part (a part indicated by the dotted line (a) in FIG. 17).

If the control portion 201 determines that the moving containing portion 51 is not filled up, the flow returns to step S571. On the other hand, if the control portion 201 determines that the moving containing portion 51 is filled up, it performs the process of discarding the partial staple legs in the moving containing portion 51 into the staple waste box 60 (step S575). The process of discarding partial staple legs cut off in step S575 is the same as the process (steps S511 to S516) shown in FIG. 14, and an explanation thereof will be omitted. When the process of discarding the partial staple legs ends, the flow returns to step S571.

Figure 20:
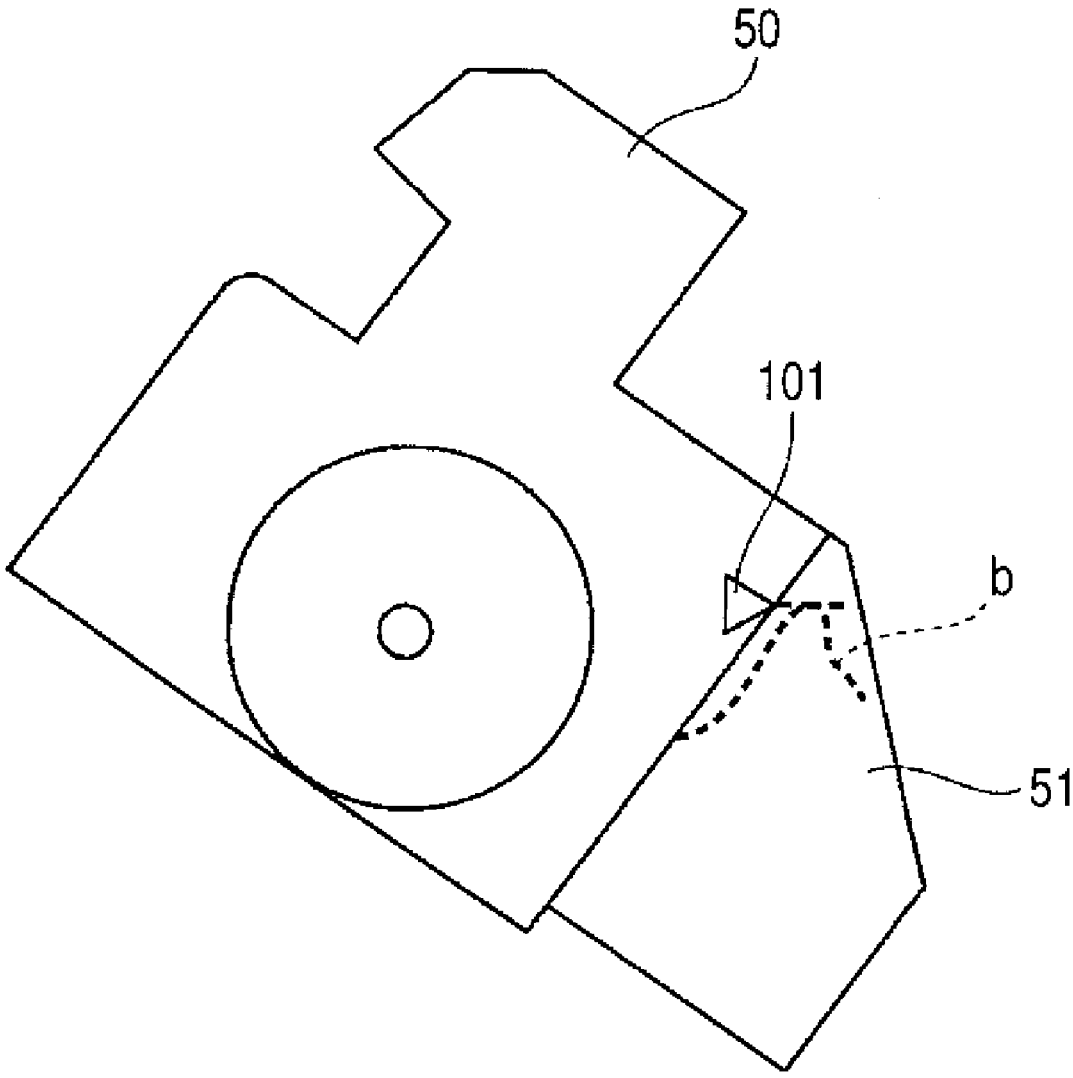
FIG. 20 is a view of an example in which a staple leg full load detection sensor detects partial staple legs.

FIG. 20 is a view showing an example in which the staple leg full load detection sensor 101 detects partial staple legs.

In FIG. 20, if a pile of partial staple legs is partially raised in the moving containing portion 51, as indicated by a dotted line (b), the top of the pile of partial staple legs may reach the top part of the moving containing portion 51 before the count of the staple counter reaches a specified value (200). Even in this case, since the staple leg full load detection sensor 101 detects the top of the pile of partial staple legs in the moving containing portion 51, the process of discarding the partial staple legs can be performed. This makes it possible to prevent partial staple legs from overflowing the moving containing portion 51.

As has been explained above, according to this embodiment, if the count of the staple counter reaches the specified value or if the staple leg full load detection sensor 101 detects the top of a pile of partial staple legs in the moving containing portion 51, the process of discarding the partial staple legs in the moving containing portion 51 into the staple waste box 60 is performed. For this reason, even if the staple leg full load detection sensor 101 fails, the process of discarding partial staple legs in the moving containing portion 51 at an appropriate time can be performed. This makes it possible to prevent partial staple legs from overflowing the moving containing portion 51 and scattering in the sheet post-processing apparatus and improve the usability.

Fifth Embodiment

A fifth embodiment of the present invention is different from the first embodiment in the points below. Other components of this embodiment are the same as the corresponding ones of the first embodiment (FIGS. 1 to 11), and an explanation thereof will be omitted.

This embodiment is a modification of the fourth embodiment. This embodiment performs the process of discarding partial staple legs contained in a moving containing portion 51 into a staple waste box 60 on the basis of a count of a storage volume counter which counts the number of partial staple legs in the moving containing portion 51.

A staple leg process of this embodiment will be explained with reference to the flowchart in FIG. 21.

Figure 21:
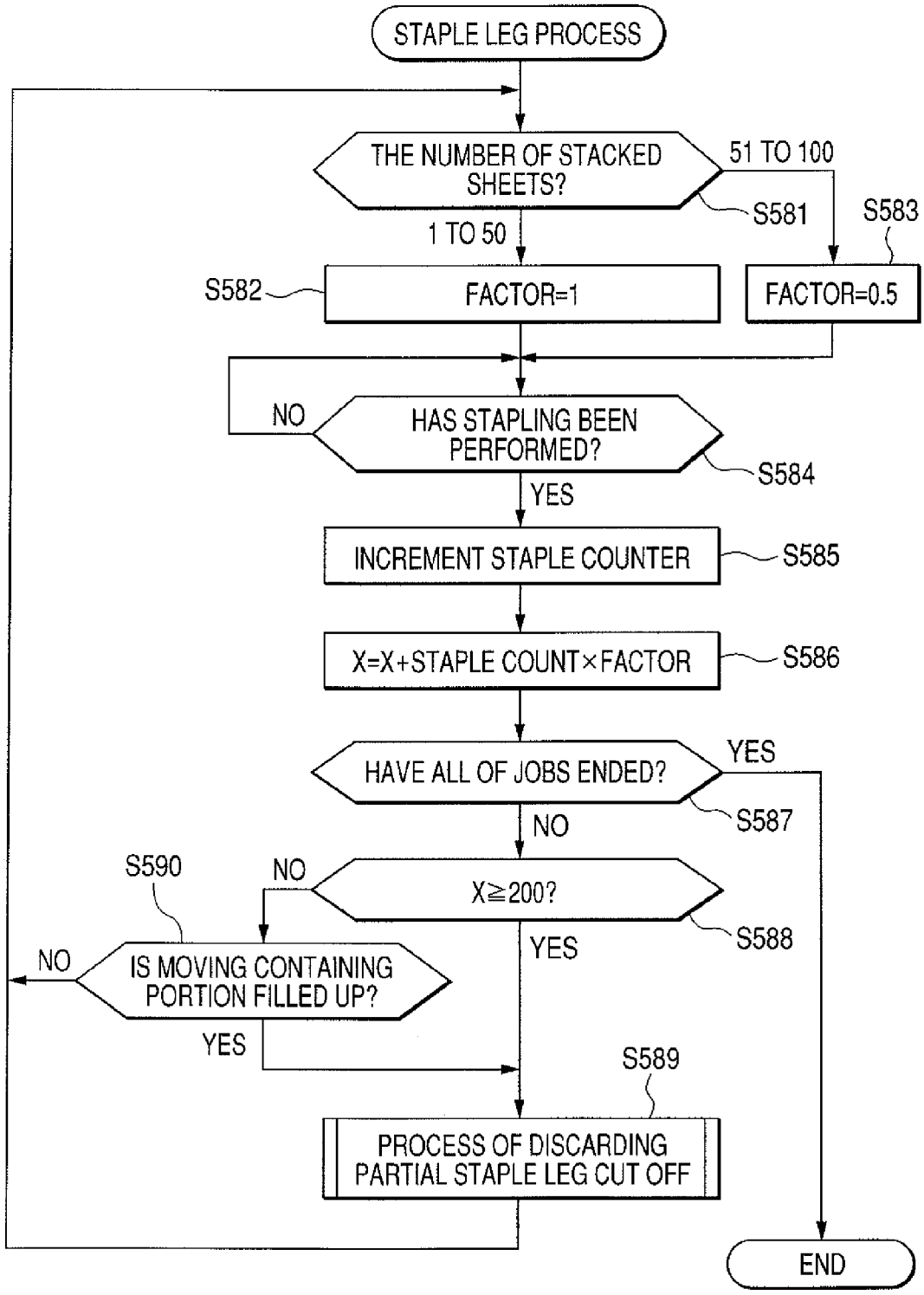
FIG. 21 is a flowchart showing a staple leg process in a sheet post-processing apparatus as a sheet processing apparatus according to a fifth embodiment of the present invention.

FIG. 21 is a flowchart showing the staple leg process.

In FIG. 21, the processes in steps S581 to S587 are the same as those in steps S531 to S537 in FIG. 16, and an explanation thereof will be omitted. A control portion 201 of a sheet post-processing apparatus determines whether or not a value X of the storage volume counter has become equal to or more than 200 (step S588). If the control portion 201 determines that the value X of the storage volume counter is less than 200, the flow advances to step S590. On the other hand, if the control portion 201 determines that the value X of the storage volume counter has become equal to or more than 200, the flow advances to step S589.

If the value X of the storage volume counter is less than 200, the control portion 201 determines whether the moving containing portion 51 is filled with partial staple legs (step S590). The determination is made on the basis of whether a staple leg full load detection sensor 101 detects that the top of a pile of partial staple legs in the moving containing portion 51 has reached a top part (a part indicated by the dotted line (a) in FIG. 17).

If the control portion 201 determines that the moving containing portion 51 is not filled up, the flow returns to step S581. On the other hand, if the control portion 201 determines that the moving containing portion 51 is filled up, it performs the process of discarding the partial staple legs in the moving containing portion 51 into the staple waste box 60 (step S589). The process of discarding partial staple legs cut off in step S589 is the same as the process (steps S511 to S516) shown in FIG. 14, and an explanation thereof will be omitted. When the process of discarding the partial staple legs cut off ends, the flow returns to step S581.

As has been explained above, according to this embodiment, if the value of the storage volume counter becomes equal to or more than a specified value or if the staple leg full load detection sensor 101 detects the top of a pile of partial staple legs in the moving containing portion 51, the process of discarding the partial staple legs in the moving containing portion 51 into the staple waste box 60 is performed. For this reason, the volume of partial staple legs in the moving containing portion 51 can be measured with higher precision, and the process of discarding partial staple legs in the moving containing portion 51 at an appropriate time can be performed. This makes it possible to prevent partial staple legs from overflowing the moving containing portion 51 and scattering in the sheet post-processing apparatus and improve the usability.

Other Embodiment

The first to fifth embodiments have each specifically explained the configuration and operation of a sheet post-processing apparatus using FIGS. 1 to 21. The present invention, however, is not limited to the embodiments, and various modifications may be made without departing from the technical idea of the present invention.

The first to fifth embodiments have each taken, as an example, a case where the control portion 201 determines the volume of partial staple legs contained in the moving containing portion 51 using a staple counter and staple leg full load detection sensor. The present invention, however, is not limited to this. The control portion 201 may be configured to determine the volume of partial staple legs expected to be contained in the moving containing portion 51 on the basis of the number of sheet stacks set in a stapling mode of binding a sheet stack obtained by aligning sheets bearing formed images conveyed from an image forming apparatus.

The first to fifth embodiments have each taken, as an example, a case where the control portion 201 determines the volume of partial staple legs contained in the moving containing portion 51 using a staple counter and staple leg full load detection sensor. The present invention, however, is not limited to this. The control portion 201 may be configured to determine the volume of partial staple legs contained in the moving containing portion 51 using, e.g., a weight detection sensor.

The object of the present invention is also achieved by supplying a storage medium having recorded thereon a program code of a software program which implements the functions of the embodiments to a system or apparatus and reading out and executing the program code stored in the storage medium by a computer (or a CPU or MPU) of the system or apparatus.

In this case, the program code itself read out from the storage medium implements the functions of the embodiments, and each of the program code and the storage medium storing the program code constitutes the present invention.

For example, a floppy (registered trademark) disk, hard disk, magnetooptical disk, CD-ROM, CD-R, CD-RW, DVD-ROM, DVD-RAM, DVD-RW, DVD+RW, magnetic tape, nonvolatile memory card, ROM, or the like can be used as a storage medium for supplying the program code. Alternatively, the program code may be downloaded over a network.

The functions of the embodiments may be implemented not only by executing the read-out program code by the computer. The present invention also includes a case where the functions of the embodiments are implemented by some or all of actual processing operations executed by an OS (Operating System) or the like running on the computer in accordance with an instruction of the program code.

The present invention further includes a case where the functions of the embodiments are implemented by some or all of actual processing operations executed by a CPU or the like arranged in a function extension board or a function extension unit which is inserted in or connected to the computer after the program code read out from the storage medium is written in memory of the extension board or unit.

According to the embodiments explained above, since movement of staple waste in the moving containing portion 51 to the staple waste box 60 is controlled on the basis of a result of determining the volume of staple waste contained in the moving containing portion 51, the process of moving staple waste in the moving containing portion 51 to the staple waste box 60 at an appropriate time can be performed. This makes it possible to prevent partial staple legs from overflowing the moving containing portion 51 and scattering in the sheet post-processing apparatus and improve the usability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-250118, filed Aug. 30, 2005, which is hereby incorporated by reference herein in its entirety.

What is claimed is:

1. A sheet processing apparatus comprising:

a sheet processing device which binds a sheet stack with a binder and cuts off an excess part of the binder;

a first containing portion configured to contain at least one binder excess cut off by said sheet processing device;

a second containing portion configured to receive the at least one binder excess from said first containing portion;

a controller which controls movement of the at least one binder excess contained in said first containing portion to said second containing portion on the basis of the volume of the at least one binder excess in said first containing portion;

a counting portion which counts the number of times of binding by said sheet processing device; and a memory which stores a weighting factor set depending on the number of sheets of a sheet stack to be bound by said sheet processing device, wherein said controller determines the volume of the at least one binder excess contained in said first containing portion on the basis of a counting result from said counting portion and the weighting factor stored in said memory.

2. The sheet processing apparatus according to claim 1, wherein:

said sheet processing device is configured to be movable together with said first containing portion, the apparatus further comprises a moving device which moves said sheet processing device to a binding position of a sheet stack, and before the at least one binder excess contained in said first containing portion are moved to said second containing portion, said moving device moves said sheet processing device to near said second containing portion.

3. The sheet processing apparatus according to claim 1, wherein a binder excess storage capacity of said second containing portion is set to be larger than a binder excess storage capacity of said first containing portion.

4. An image forming apparatus comprising a sheet processing apparatus according to claim 1.

5. The image forming apparatus according to claim 4, wherein:

the image forming apparatus forms an image on a sheet and conveys the sheet bearing the formed image to said sheet processing apparatus, and said sheet processing apparatus aligns a plurality of sheets received from the image forming apparatus to form a sheet stack and binds the sheet stack.

6. A sheet processing apparatus comprising:

a sheet processing device which binds a sheet stack with a binder and cuts off an excess part of the binder;

a first containing portion configured to contain at least one binder excess cut off by said sheet processing device;

a second containing portion configured to receive the at least one binder excess from said first containing portion;

a controller which controls movement of the at least one binder excess contained in said first containing portion to said second containing portion on the basis of the volume of the at least one binder excess in said first containing portion;

a counting portion which counts the number of times of binding by said sheet processing device;

a memory which stores a weighting factor set depending on the number of sheets of a sheet stack to be bound by said sheet processing device; and a sensor which detects the volume of the at least one binder excess contained in said first containing portion, wherein said controller determines the volume of the at least one binder excess contained in said first containing portion on the basis of a counting result from said counting portion, the weighting factor stored in said memory, and a detection result from said sensor.

* * * * *